US005737682A

United States Patent [19]

Yamagishi

[11] Patent Number: 5,737,682

[45] Date of Patent: Apr. 7, 1998

[54] DUPLEX SHEET FEEDING DEVICE FOR AN IMAGE FORMING APPARATUS

[75] Inventor: Masaru Yamagishi, Tokyo, Japan

[73] Assignee: Ricoh Company, Ltd., Tokyo, Japan

[21] Appl. No.: 724,783

[22] Filed: Oct. 3, 1996

[30] Foreign Application Priority Data

| | | | |
|---|---|---|---|
| Oct. 3, 1995 | [JP] | Japan | 7-256480 |
| Dec. 15, 1995 | [JP] | Japan | 7-327533 |
| Dec. 20, 1995 | [JP] | Japan | 7-332019 |

[51] Int. Cl.[6] ..... G03G 21/00

[52] U.S. Cl. ..... 399/402; 399/364; 271/3.03; 271/9.07

[58] Field of Search ..... 399/402, 401, 399/364; 271/3.03, 9.01, 9.02, 9.07

[56] References Cited

U.S. PATENT DOCUMENTS

| | | | |
|---|---|---|---|
| 4,272,180 | 6/1981 | Satomi et al. . | |
| 4,905,053 | 2/1990 | Matsuo et al. | 355/319 |
| 5,150,168 | 9/1992 | Kamath et al. | 355/319 |
| 5,165,675 | 11/1992 | Kanaya | 271/3.1 |
| 5,165,677 | 11/1992 | Shinada | 271/3.1 |
| 5,594,542 | 1/1997 | Sugimoto et al. | 399/402 |

FOREIGN PATENT DOCUMENTS

| | | |
|---|---|---|
| 58-102254 | 6/1983 | Japan . |
| 7-104527 | 4/1995 | Japan . |
| 7-181761 | 7/1995 | Japan . |

*Primary Examiner*—R. L. Moses

*Attorney, Agent, or Firm*—Oblon, Spivak, McClelland, Maier & Neustadt, P.C.

[57] ABSTRACT

A miniature duplex sheet feeding device for an image forming apparatus is disclosed. A duplex unit is positioned above an ordinary sheet feed tray loaded with a stack of sheets. The duplex unit has an intermediate tray for stacking sheets each carrying an image on one side thereof, and a bottom plate movable back and forth in an intended direction of sheet refeed. The sheet feed tray and duplex unit share a single sheet pay-out means. The bottom plate includes separators for retaining the leading edge of the sheet stack and allowing the stack to be bodily shifted to a preselected refeed position.

25 Claims, 32 Drawing Sheets

DUPLEX SHEET FEEDING DEVICE FOR AN IMAGE FORMING APPARATUS

BACKGROUND OF THE INVENTION

The present invention relates to a duplex sheet feeding device for an image forming apparatus and, more particularly, to a miniature duplex sheet feeding device having an ordinary sheet feed tray and a duplex unit arranged one above the other and sharing a single sheet pay-out means.

An image forming apparatus having a duplex sheet feeding function for forming images on both sides of a sheet is conventional. It is a common practice with this type of image forming apparatus to mount an ordinary sheet feed tray in its bottom portion and arrange a sheet refeeding device or duplex unit above the ordinary tray. The duplex unit receives sheets each carrying an image on one side thereof and then refeeds them toward an image forming section, so that an image can be formed on the other side of each sheet. However, stacking the sheet feed tray and duplex unit independently one above the other requires a broad space, particularly in the direction of height. This is contrary to the increasing demand for a miniature and inexpensive configuration. In light of this, a miniature duplex sheet feeding device having the ordinary tray and duplex unit constructed into a single stacked unit and sharing a single sheet pay-out means has been proposed in various forms.

However, even the duplex sheet feeding device with the above configuration provides the pay-out means with a pick-up function, retracting mechanism and so forth. This, coupled with sheet separating means, increases the cost of the apparatus. Moreover, when the device shifts the stack of one-sided sheets to a preselected refeed position at a time, it lacks in reliability as to curled sheets because members for surely pressing, e.g., the leading edge of the stack are absent.

SUMMARY OF THE INVENTION

It is therefore an object of the present invention to provide a duplex sheet feeding device having a simple shared sheet feed mechanism to reduce the cost, and capable of shifting a sheet stack with improved reliability.

It is another object of the present invention to provide a duplex sheet feeding device having a thin configuration with a minimum number of parts, and capable of surely setting up a sheet feed condition by obviating the deformation of an arm supporting a movable bottom plate included in an intermediate tray and by obviating excessive friction.

It is a further object of the present invention to provide a duplex sheet feeding device capable of surely guiding even the opposite edges of curled sheets in its turn-over section and thereby enhancing the accurate stacking of sheets on an intermediate tray.

In accordance with the present invention, a duplex sheet feeding device includes a sheet feed tray for storing a stack of sheets. A pay-out member pays out sheets one by one. A sheet feeding device conveys sheets one by one while separating them, and includes separators positioned in front of the sheet feed tray and respectively contac opposite side edges of the leading edge of the stack. A duplex unit is disposed in a space above the sheet feed tray and rearward of the pay-out means. The duplex unit has an intermediate tray for receiving a stack of sheets each carrying an image on one side thereof, and a bottom plate movable back and forth in an intended direction of sheet refeed while supporting the leading edge of the stack. The bottom plate includes separators. The bottom plate shifts the stack of sheets loaded on the intermediate tray to a preselected refeed position and then causes the sheets to be refed to an image forming section while sharing the pay-out member with the sheet feed tray.

Also, in accordance with the present invention, a duplex sheet feeding device includes a sheet feed tray including a first movable bottom plate, and for storing a stack of sheets. A pay-out member feeds sheets with a roller being pressed against the sheets. A sheet feeding device conveys sheets one by one while separating them, and includes separators positioned in front of the sheet feed tray and respectively contacting opposite side edges of the leading edge of the stack. A duplex unit is disposed in a space above the sheet feed tray and rearward of the pay-out means. The duplex unit has an intermediate tray for receiving a stack of sheets each carrying an image on one side thereof, and a second movable bottom plate movable back and forth in an intended direction of sheet refeed while supporting the leading edge of the stack. After the stack loaded on the intermediate tray and supported by the second movable bottom plate has been bodily shifted to a preselected refeed position, the first movable bottom plate of the sheet feed tray is raised to thereby raise the second movable bottom plate. The sheets shifted to the preselected refeed position are refed toward an image forming section by the pay-out member shared by the sheet feed tray and duplex unit. The second movable bottom plate includes a presser portion for pressing the sheets stacked on the sheet feed tray in contact with the sheets. The presser portion is positioned close to the fulcrum of rotation of the second movable bottom plate with respect to a line on which the pay-out member presses the sheets.

Further, in accordance with the present invention, a duplex sheet feeding device for an image forming apparatus includes a sheet feed tray including a first movable bottom plate, and for storing a stack of sheets. A pay-out member feeds sheets with a roller being pressed against the sheets. A sheet feeding device is positioned in front of the sheet feed tray for conveying sheets one by one while separating them. A duplex unit is disposed in a space above the sheet feed tray and rearward of the pay-out member, and has an intermediate tray for receiving a stack of sheets each carrying an image on one side thereof. Sheets sequentially conveyed from an image forming section of the image forming apparatus are each turned over by a turn-over section and then stacked on the intermediate tray. The pay-out member sequentially refeeds the sheets one by one toward the image forming section. The intermediate tray includes side fences having respective turn-over guide members for guiding opposite side edges of the sheets. The turn-over guide members guide the inner surfaces of said sheets.

Moreover, in accordance with the present invention, a duplex sheet feeding device for an image forming apparatus includes a sheet feed tray including a first movable bottom plate, and for storing a stack of sheets. A pay-out member feeds sheets with a roller being pressed against the sheets. A sheet feeding device is positioned in front of the sheet feed tray for conveying sheets one by one while separating them. A duplex unit is disposed in a space above the sheet feed tray and rearward of the pay-out member, and has an intermediate tray for receiving a stack of sheets each carrying an image on one side thereof. Sheets sequentially conveyed from an image forming section of the image forming apparatus are each turned over by a turn-over section and then stacked on the intermediate tray. The pay-out member sequentially refeeds the sheets one by one toward the image forming section. The turn-over section has a drive side consisting of a drive roller, a turn belt, and an auxiliary roller, and a driven side in a form of a turn roller rotatably mounted on a turn shaft.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the duplex sheet feeding device in accordance with the present invention will be described hereinafter.

1st Embodiment

Figure 1:
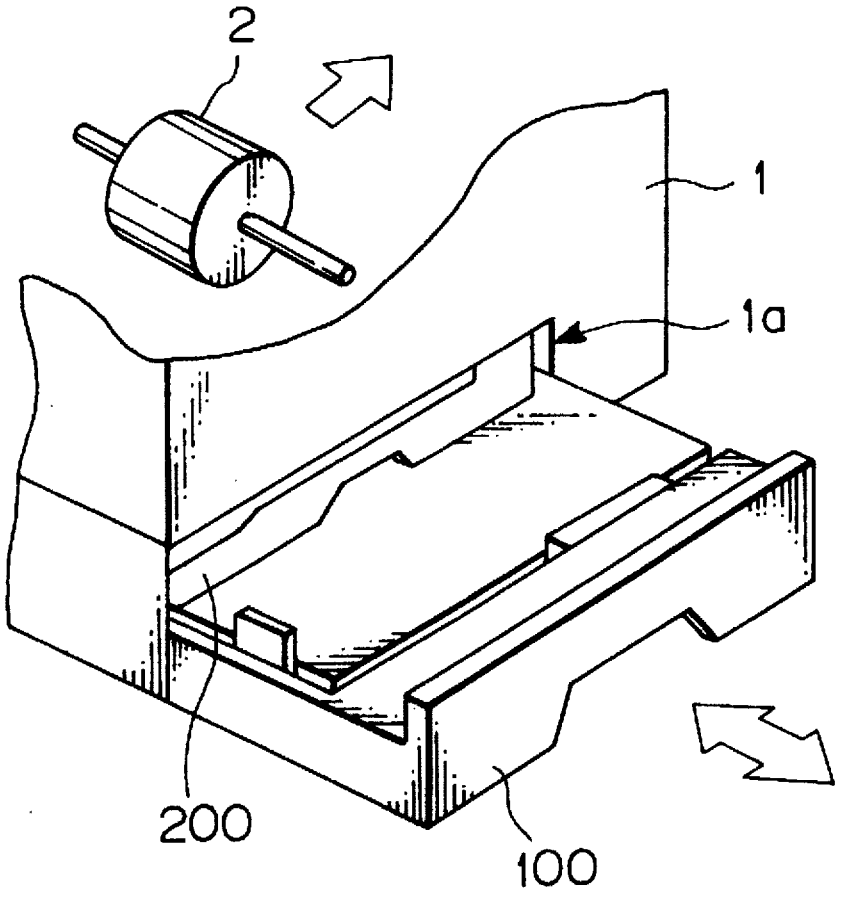
FIG. 1 is a perspective view showing a sheet feed tray pulled out of the body of an image forming apparatus.

Referring to FIG. 1 of the drawings, an image forming apparatus has a body 1 formed with an opening 1*a* at its lower portion. A sheet feed tray 100 and a duplex unit 200 are disposed in the body 1 one above the other. The sheet feed tray 100 and duplex unit 200 can be pulled out of the body 1 independently of each other in the direction perpendicular to an intended direction of sheet feed. The tray 100 is shown in a position pulled out from the body 1. The tray 100 and duplex unit 200 share pick-up means 2 schematically shown in FIG. 1.

Figure 2:
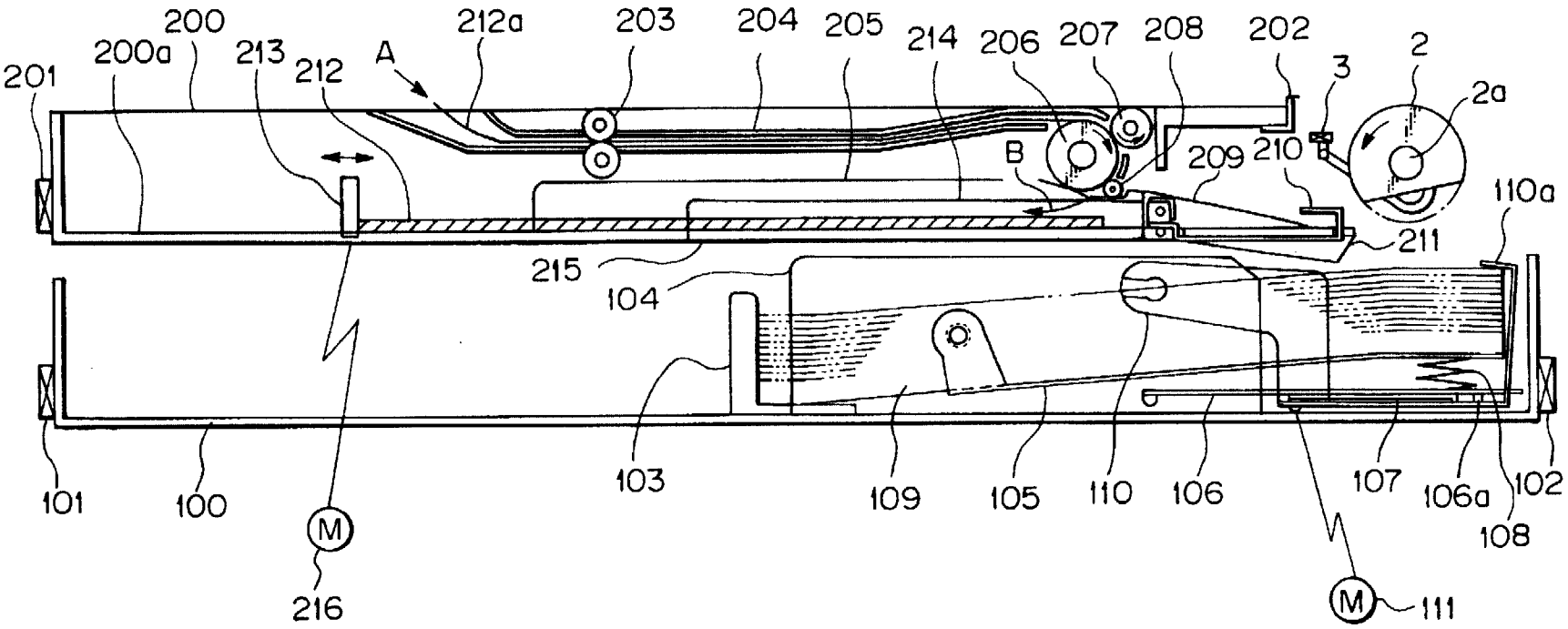
FIG. 2 is a section showing a first embodiment of the duplex sheet feeding device in accordance with the present invention.

FIG. 2 shows a duplex sheet feeding device embodying the present invention. As shown, the sheet feed tray 100 is located below the duplex unit 200. A roller having a semicircular section or similar pay-out means 2 is positioned above and in front of the sheet feed tray 100 and in front of the duplex unit 200. The pay-out means 2 is shared by the sheet feed tray 100 and duplex unit 200, as will be described later. The pick-up means 2 has a roller and a shaft 2*a* on which it is mounted.

The duplex unit 200 is supported by tray guides 201 and 202 while the sheet feed tray 100 are supported by tray guides 101 and 102. The unit 200 and tray 100 can each be pulled out in the direction perpendicular to the sheet surface of FIG. 2. The duplex unit 200 includes an intermediate tray 200*a* capable of accommodating a preselected number of sheets. A sheet 212*a* carrying an image on one surface thereof enters the duplex unit 200 in a direction indicated by an arrow A. To turn over the sheet 212*a* before it is received in the tray 200*a*, there are provided a horizontal path 204, a conveyor roller pair 203, a turn over 206, a press roller 207, and an auxiliary press roller 208. The turn roller 206 is located at the front end (right end as viewed in FIG. 2) of the horizontal path 204 in order to turn over the sheet 212*a*. The auxiliary press roller 208 is positioned at the lower end of the turn roller 206 and causes the sheet 212*a* to enter the tray 200*a* in a direction indicated by an arrow B. Further, the auxiliary press roller 208 serves to surely convey the trailing edge of the sheet 212*a* into the tray 200*a*.

An movable end fence 213 and a movable side fence 205 are used to position sheets 212 stacked on the tray 200*a*. The end fence 213 positions the trailing edges (right edges as viewed in FIG. 2) of the sheets 212 while the side fence 205 positions the adjoining side edges of the sheets 212. The fences 213 and 205 are driven by, e.g., a motor 216. A movable bottom plate 211 is positioned in front of the tray 200*a* in order to support the leading edge (right edge as viewed in FIG. 2) of the sheet stack 212 received in the tray 200*a*. The bottom plate 211 is movable back and forth in an intended direction of sheet refeed by being driven by, e.g., a motor. The bottom plate 211 includes a separator 210 which retains the adjoining side of the leading edge of the sheet stack 212 in the event of shift or separates the sheets 212 one by one in the event of refeed. The separator 210 is rotatably supported by a respective arm 214. The arm 214 extends below the bottom plate 211 and is rotatably supported by a separator arm 214. The separator arm 214 is supported by the side fence 205 in such a manner as to be slidable in the refeed direction (right-and-left direction as viewed in FIG. 2).

A guide member 209 is disposed above the bottom plate 211 and is mounted on the side fence 213 in the illustrative embodiment. The guide member 209 guides the adjoining side edge of the sheet stack 212 from the above and causes the leading edge of the stack 212 being shifted to slide into the separator 210. The bottom plate 211 is rotatably supported by an arm 215 which is disposed below the tray 200*a* and slidable back and forth in the refeed direction.

The sheet feed tray 100 has a first bottom plate 105 for supporting a sheet stack 109, and a second bottom plate 106 disposed below the first bottom plate 105. A spring 108 is loaded between the bottom plates 105 and 106. An elevatable arm 107 is positioned below the bottom plate 106 and connected to an elevation motor 111. The motor 111 selectively causes the bottom plate 106 to move up or down, so that the top of the sheet stack 109 is movable between a feed position and a retracted position. Elevation sensing means 3 is located beneath the pick-up means 2. A separator 110 is positioned at the front end of the tray 100 in order to separate the sheets 109 one by one. The sheet stack 109 is positioned by a side fence 104 and an end fence 103. The bottom plate 106 includes a stop member 106*a*.

Figure 3:
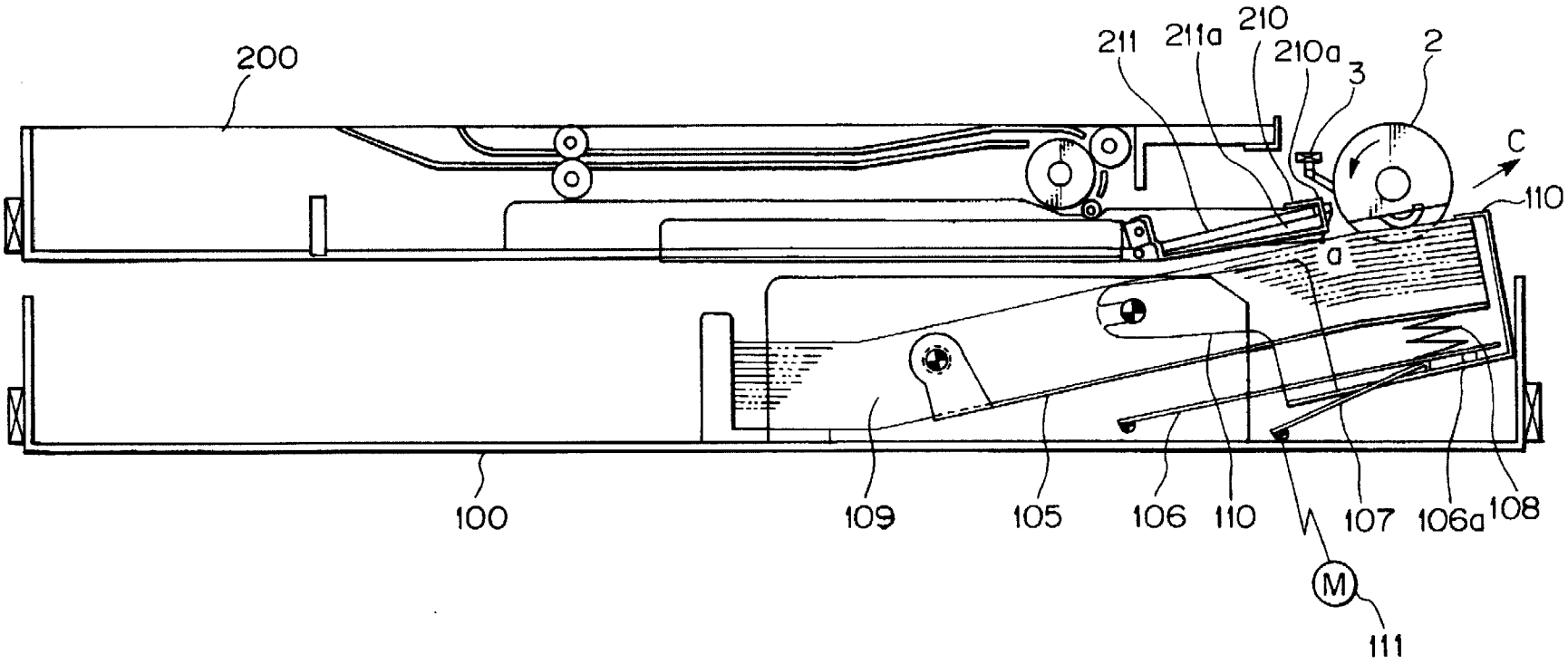
FIG. 3 is a section showing the embodiment in a condition for feeding sheets from a sheet feed tray.
Figure 4:
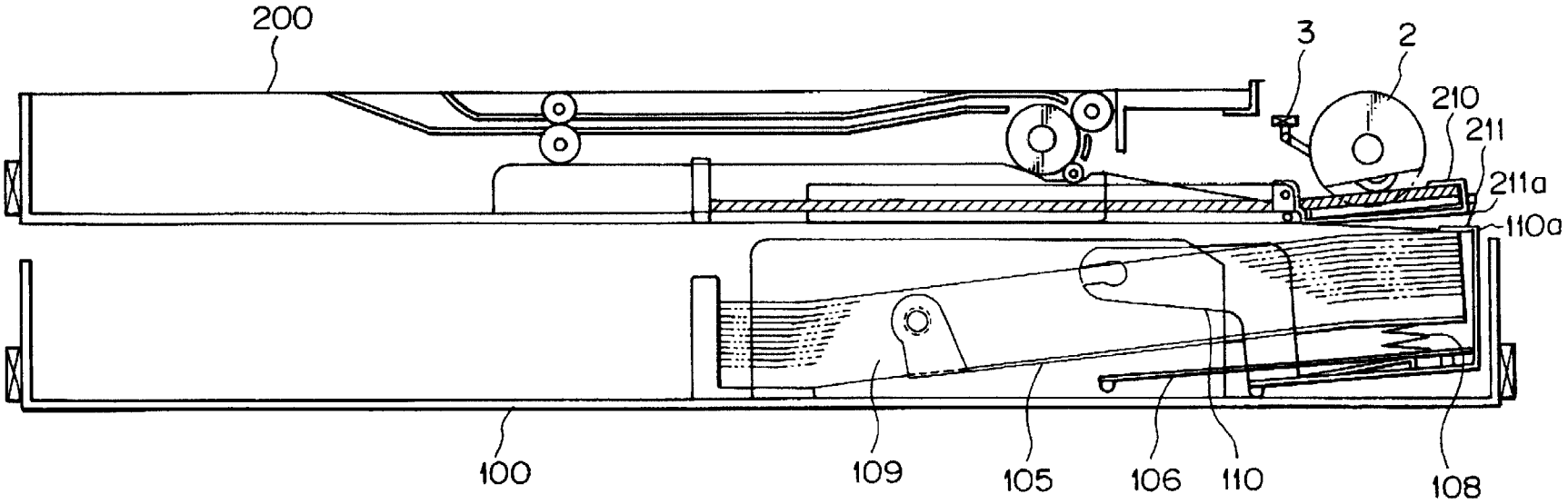
FIG. 4 is a section showing the embodiment in a condition for refeeding sheets each carrying an image on one side thereof from a duplex unit.

FIG. 3 shows how the sheets 109 are fed from the sheet feed tray 100 while FIG. 4 shows how the sheets 212 are refed from the duplex unit 200. As shown in FIG. 3, to feed the sheets 109, the motor 111 is energized to raise the bottom plate 106 via the arm 107. The bottom plate 105 and sheet stack 109 loaded thereon are elevated by the bottom plate 106 to a position where the sheets 109 can be fed one by one. In this condition, the pay-out means 2 and separator 110 separates and feeds the top sheet 109 in a direction indicated by an arrow C in FIG. 3. At this instant, the elevation sensing means 3 senses the amount of elevation of the bottom plate 105. The stop member 106*a* restricts the separator 110 with respect to the elevation. Specifically, the end 110*a* of the separator 110 and the stop member 106*a* receive the force of the spring 108.

The top of the sheet stack 109 abuts, at a point a shown in FIG. 3, against a projection 211*a* (best shown in FIG. 8) protruding downward from the bottom wall 211 of the duplex unit 200. As a result, the bottom wall 211 is raised to its retracted position. At this instant, the separator 210 abuts against the bottom plate 211 at its end 210*a* due to its own weight, and therefore retracts upward together with the bottom plate 211. This successfully increases the space efficiency of the duplex unit 200. In this manner, the bottom plate 211 is retractable without resorting to any special retracting mechanism. Stated another way, even when the bottom plate 211 lacks the projection 211*a*, the above effect is achievable if use is made of, e.g., a retracting mechanism using a solenoid and a lever.

Referring again to FIG. 2, how the sheet 212*a* carrying an image on one side thereof is stacked on the duplex unit 200 will be described. The sheet 212*a* entering the duplex unit 200 in the direction A is conveyed by the conveyor roller pair 203 along the horizontal path 204. The turn roller 206 and press roller 207 cooperate to turn over the sheet 212*a*. Then, the press roller 207 cooperates with the turn roller 206 to convey the sheet 212*a* into the intermediate tray 200*a* in the direction B. At this instant, the end fence 213 should preferably be located beforehand at a position where it can position the trailing edge of the sheet 212*a*. The side fence 205 positions the adjoining side edge of the sheet stack 212, as indicated by hatching in FIG. 2. The above procedure is repeated a preselected number of times corresponding to a desired number of sheets.

Figure 5:
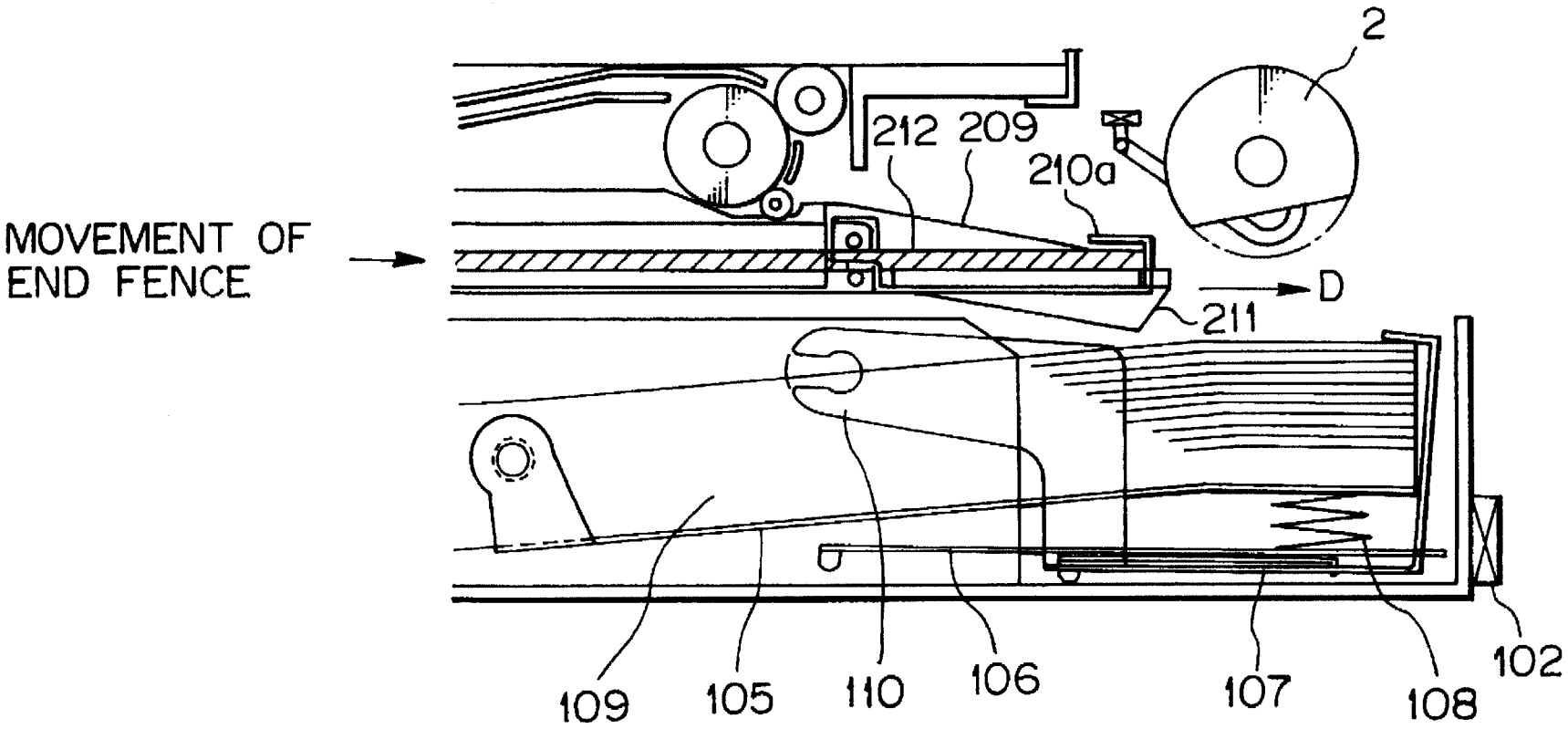
FIGS. 5 and 6 respectively show a first and a second stage for shifting a sheet stack loaded on an intermediate tray to a refeed position.
Figure 6:
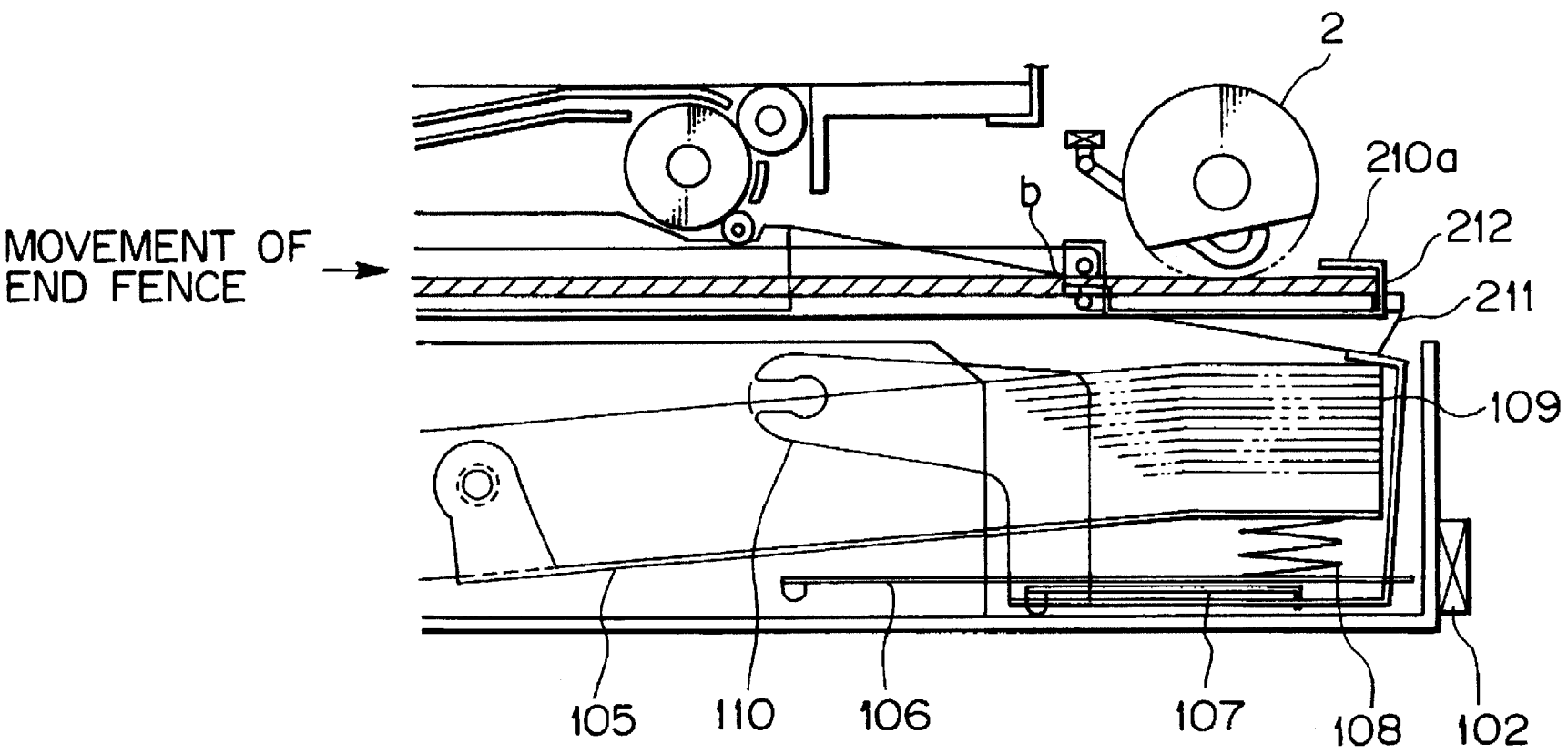

FIG. 5 shows the first stage of an operation for shifting the sheet stack 212 on the intermediate tray 200*a* to a preselected refeed position (only the end fence 212 is moved). FIG. 6 shows a second stage of of the same operation (both the end fence 212 and the bottom plate 211 are moved). Before the transition from the sheet feed from the sheet feed tray 100 shown in FIG. 3 to the sheet feed from the duplex unit 200, the bottom plates 105 and 106 of the tray 100 are retracted.

As shown in FIG. 5, the end fence 213 is moved to shift the sheet stack 212 in the refeed direction (to the right as viewed in FIG. 2) until the leading edge of the stack 212 gets under the end 210*a* of the separator 210. At this instant, the bottom plate 211 remains stationary. The guide member 209 prevents the leading edge of the stack 212 from rising and allows it to surely slide into the separator 210. This will be described more specifically later with reference to FIGS. 9 and 10. The guide member 209 should preferably slightly overlap with the separator 210.

At the second stage, the end fence 213 and bottom plate 211 are moved at the same speed in the refeed direction, as indicated by an arrow D in FIG. 5. When the bottom plate 211 is brought to a position between the pay-out means 2 and the sheet stack 109 of the sheet feed tray 100, the shift of the sheet stack 212 ends, as shown in FIG. 6. Although the end of the guide member 209 is released from the end of the separator 210 and the leading edge of the sheet stack 212, it continuously guides the opposite upper edge portions (point b) of the stack 212 and thereby prevents the stack 212 from waving or otherwise rising.

The refeed from the duplex unit 200 will be described more specifically with reference to FIG. 7 which is a fragmentary enlarged view of the arrangement shown in FIG. 4. In the condition shown in FIG. 6, the bottom plate 106 of the sheet feed tray 100 is raised in the previously stated manner. The bottom plate 106 raises the bottom plate 105, i.e., the sheet stack 109 loaded thereon. The sheet stack 109 abuts against the projection 211*a* of the bottom plate 211 at a point c and then raises the bottom plate 211 to its refeed level. This is sensed by the elevation sensing means 3, as stated earlier. As a result, the duplex unit 200 and sheet feed tray 100 can share the pick-up means 2 and the spring 108. If desired, exclusive biasing means may be used to bias the bottom plate 211, in which case the bottom plates 105 and 106 will be retracted downward.

Figure 8:
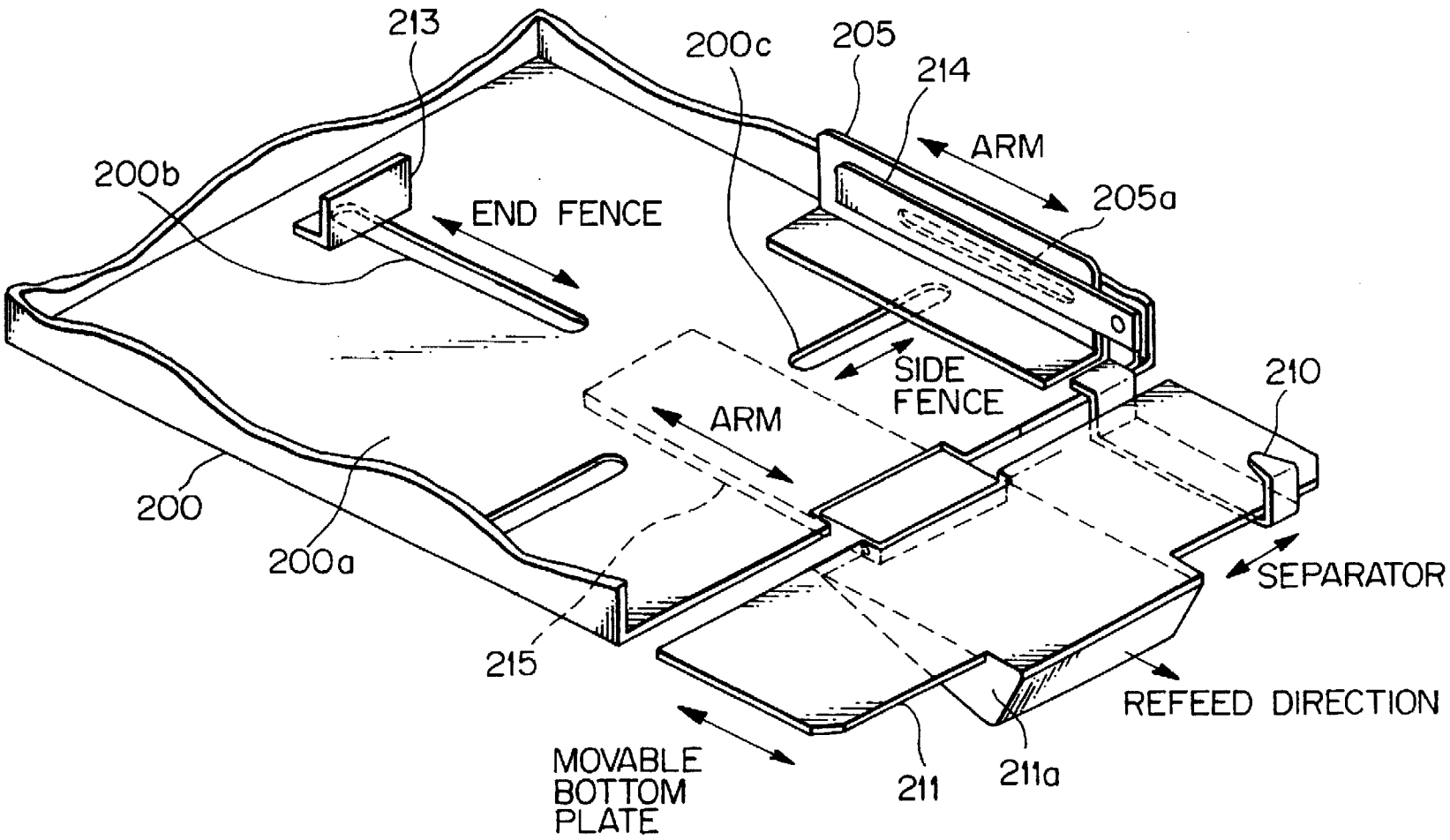
FIG. 8 is a perspective view showing an essential part of the duplex unit.
Figure 13:
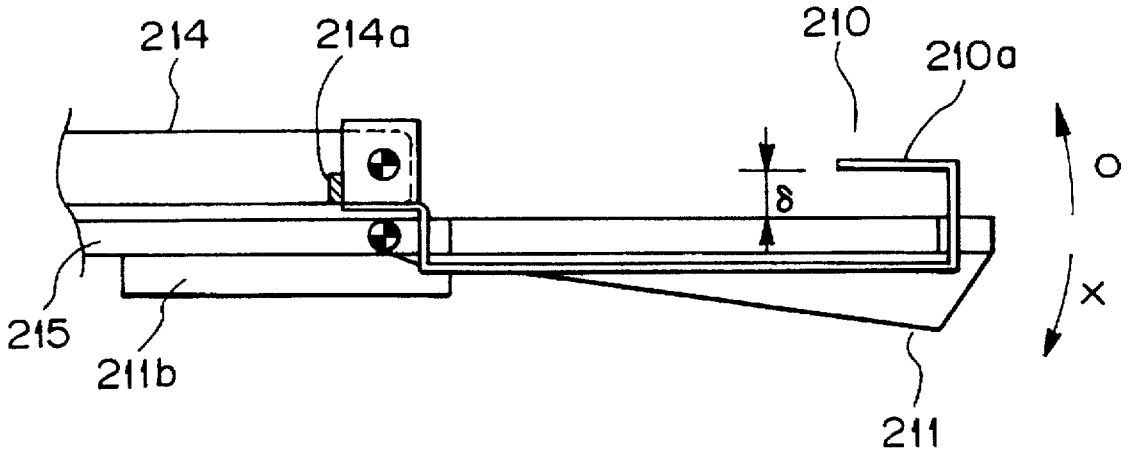
FIG. 13 shows the bottom plate in a stand-by condition.
Figure 14:
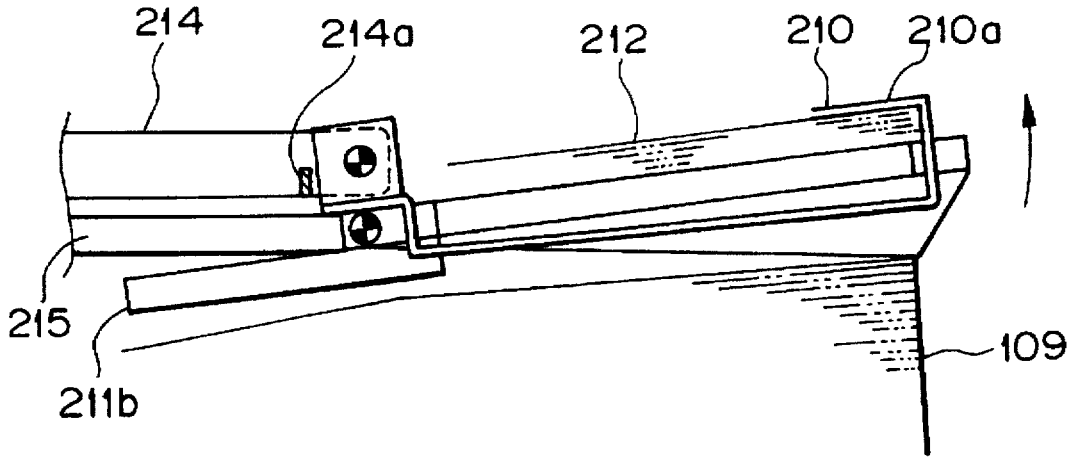
FIG. 14 shows the bottom plate in a refeed condition.

An essential part of the duplex unit 200 is shown in FIG. 8. While the side fence 205, separator 210 and so forth are each provided in a pair spaced in the front-and-rear direction, only the rear members are shown in FIG. 8. As shown, the end fence 213 is movable back and forth along a channel 200*b* formed in the bottom of the intermediate tray 200*a*. A motor or similar drive means for moving the end fence 213 is not shown. The arm 215 is mounted on the intermediate tray 200*a* to be movable back and forth in the refeed direction relative to the tray 200*a*. The bottom plate 211 is rotatably supported by the end of the arm 215. As shown in FIGS. 13 and 14, the bottom plate 211 includes an extension 211*b* positioned below the arm 215, so that the bottom plate 211 is rotatable only upward. The bottom plate 211 is therefore movable while remaining in a horizontal position, thereby enhancing the reliable shift of the sheet stack.

The separator 210 is rotatably supported by the end of the separator arm 214 which is slidable along a slot 205*a* relative to the side fence 205 in the refeedable direction. The separator 210 extends along the underside of the bottom plate 211 and faces the bottom plate 211 at its end, as illustrated so that it is movable in the refeed direction together with the bottom plate 211. The side fence 205 is movable sideways along a channel 200*c* by being driven by a motor or similar drive means. Therefore, the separator 210 is also movable sideways together with the side fence 205, positioning the sheet stack 212 sideways.

The projection 211*a* of the bottom plate 211 is positioned inward of the separator 210, as illustrated. The projection 211*a* has a width smaller than the width of the smallest sheet size available with the sheet feed tray 100. In this condition, the separator 210 and separator 110 are prevented from interfering with each other. The interference is problematic in the case of the refeed from the duplex unit 200, as shown in FIGS. 4 and 7. Further, the separator 210 is movable sideways (for positioning) when the bottom plate 211 is retracted, as shown in FIG. 3. In addition, because the separator arm 214 moves in the refeed direction together with the bottom plate 211 and separator 210 in the event of refeed (FIG. 7), the arm 214 positioned inward of the side fence 205 is capable of guiding the adjoining side edge of the sheet stack. This successfully prevents the sheets from being refed askew.

Figure 9:
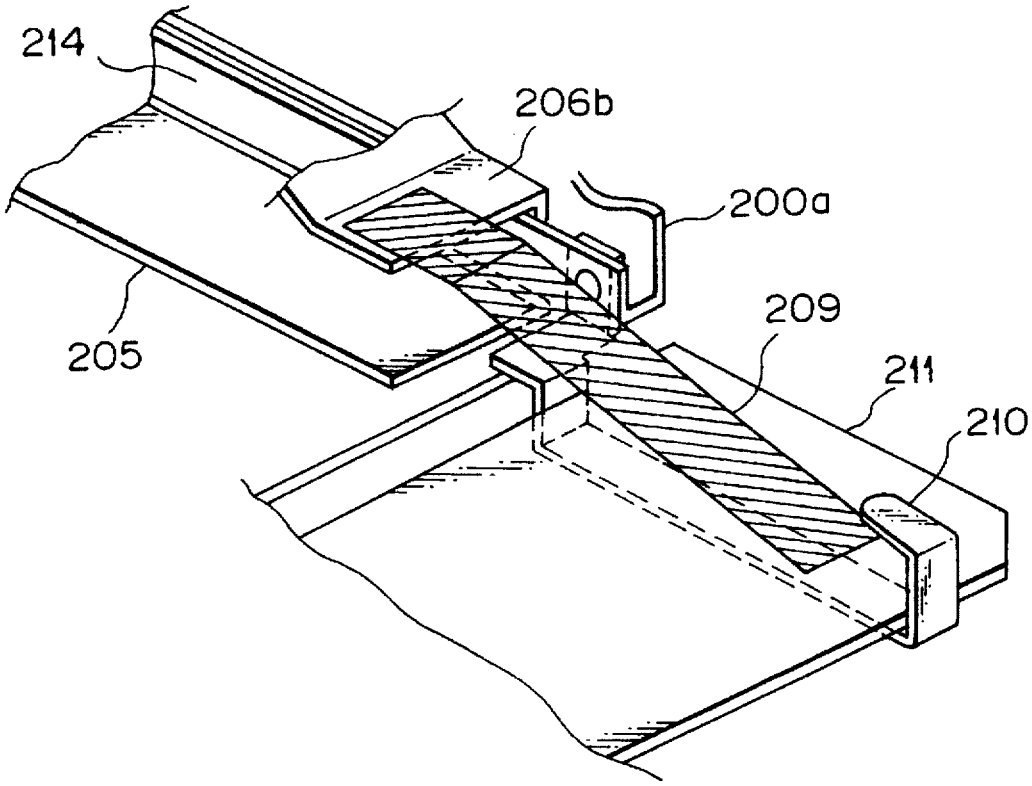
FIGS. 9 and 10 are respectively a perspective view and a side elevation demonstrating the function of a guide member.
Figure 10:
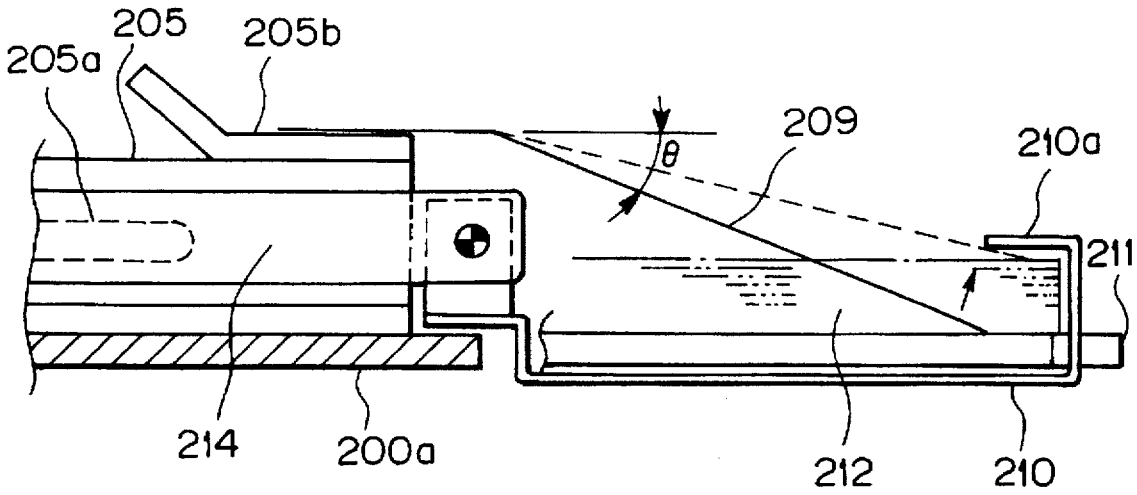

As shown in FIGS. 9 and 10, a guide 205*b* is provided on the side fence 205. The guide member 209 is provided on the guide 205*b* and formed of, e.g., Mylar. The guide member 209 is positioned at an angle θ, FIG. 10, so that it does not interfere with the separator 210 when the bottom plate 211 is returned to its home position (FIGS. 9 and 10). When the sheet stack 212 is, shifted until its leading edge gets under the end 210*a* of the separator 210, the guide member 209 is retracted upward by the top of the stack 212, as indicated by an arrow E in FIG. 10. Hence, the leading edge of the stack 212 can be surely brought to below the separator 210.

As shown in FIGS. 13 and 14, the separator arm 214 includes stopping means 214*a* in the form of a lug in order to allow the separator 210 to rotate only upward. Also, the lug 214*a* maintains the end 210*a* of the separator 210 and the bottom plate 211 spaced by a gap δ at all times. Such a configuration facilitates the entry of the leading edge of the sheet stack 212 into the space below the separator 210. In the event of refeed shown in FIG. 14, because the separator 210 is rotatable only upward, the elevation of the bottom plate 211 allows the end 210*a* of the separator 210 to contact the leading edge of the sheet stack 212 and separate the sheet due to its own weight. In FIG. 13, a circle indicates that the separator 210 is movable upward while a cross indicates that it is not movable downward.

Figure 11:
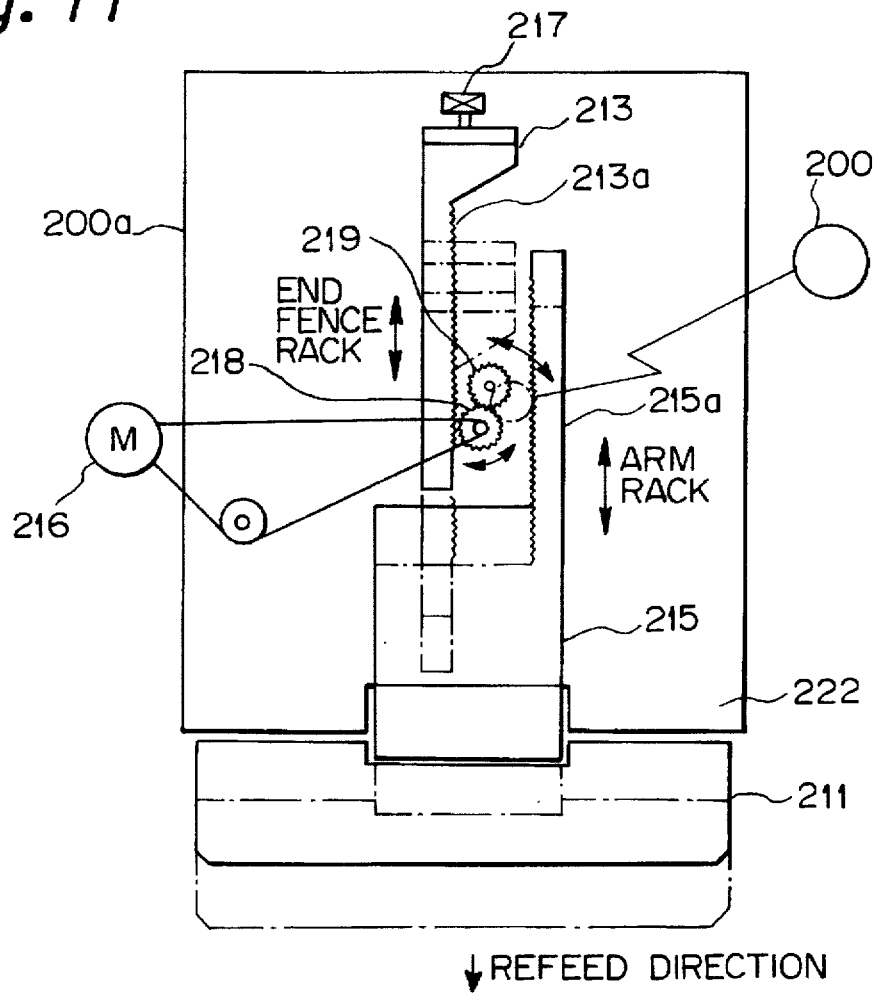
FIG. 11 is a plan view showing a mechanism for driving a movable end fence and a movable bottom plate.
Figure 12:
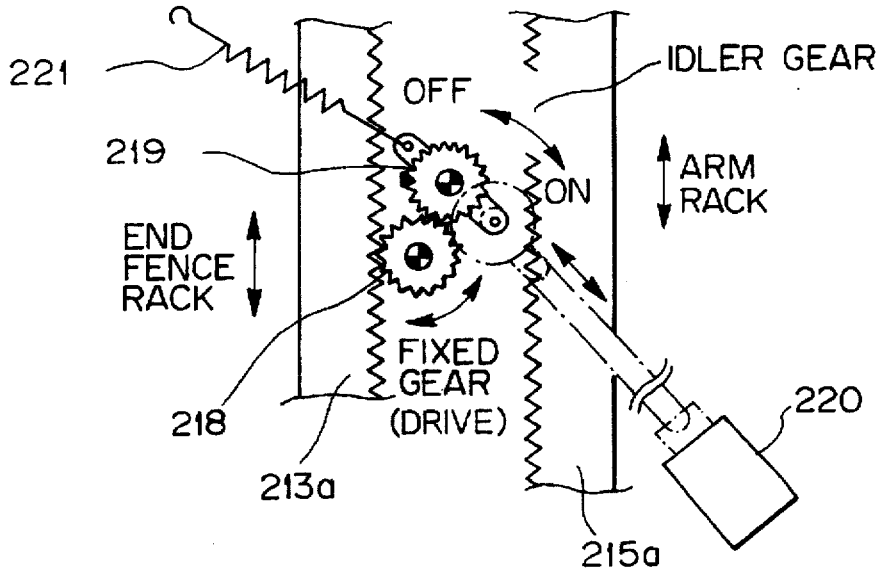
FIG. 12 is a fragmentary enlarged plan view of the mechanism shown in FIG. 11.

FIG. 11 shows a mechanism for moving the end fence 213 and bottom plate 211 while FIG. 12 shows it in a fragmentary enlarged view. As shown, the end fence 213 and arm 215 are formed with racks 213*a* and 215*a*, respectively. Home position sensing means 217 is positioned at the rear of the end fence 213. Interposed between the racks 213*a* and 215*a* is selective connecting means including a fixed gear 218 connected to a motor 216, an idler gear 219 rotatable in contact with the gear 218, a solenoid 220 for actuating the idler gear 219, and a spring 221.

When the solenoid 220 is turned off, the idler gear 219 is held in its retracted position by the spring 221. In this condition, the rack 215*a* of the arm 215 is not driven while only the end fence 213 is driven. When the solenoid 220 is turned on, the idler gear 219 is movable along the periphery of the fixed gear 218 and brought into mesh with the rack 215*a*, setting up drive transmission. Then, the end fence 213 and arm 215 are moved in the same direction as each other. In this manner, the end fence 213 and bottom plate 211 are moved by a single drive means, and the drive connection can be switched over at a desired position or timing.

As stated above, in the illustrative embodiment, the movable bottom plate 211 includes the separators 210. After the sheet stack 212 supported by the bottom plate 211 has been collectively shifted to the refeed position, the shared pay-out means 2 refeeds the sheets to an image forming section. This enhances the reliable shift of the sheet stack. Moreover, with the simple and inexpensive pay-out means not using pick-up means or retracting means, it is possible to refeed the sheets from the duplex unit 200, so that the duplex sheet feeding device is inexpensive.

In the event of sheet feed from the sheet feed tray 100, the movable bottom plate 211 overlying the tray 100 is retracted upward. This enhances the space efficiency of the duplex unit 200.

The separators 210 movable back and forth in the refeed direction are each mounted on the respective movable side fence 205 included in the duplex unit 200. Therefore, the separator 210 is movable in interlocked relation to the widthwise movement of the side fence 205, thereby accommodating various sizes of sheets.

The movable end fence 213 positions the trailing edge of the sheet stack loaded on the intermediate tray 200*a*, and pushes the sheet tack until its leading edge reaches the refeed position. This, coupled with the fact that the bottom plate 211 is interlocked to the end fence 213, allows the end fence 213 to push the tailing edge of the sheet stack and thereby enhances reliable shift. Further, the end fence 213 and bottom plate 211 can be selectively driven by a single drive means, so that the cost is reduced.

The guide members 209 overlie the separators 110 of the duplex unit 200 at positions for guiding the opposite side edges of the sheet stack. Because the guide members 209 prevent the sheets from rising, they allow the leading edge of the sheet stack to surely get under the ends 110*a* of the separators 110. This further enhances the reliable shift of the sheets stack.

The sheet feed tray 100 includes the first bottom plate 105 for stacking the sheets, and the second bottom plate 106 sustaining the bottom plate 105 with the intermediary of the spring or similar pressing means 108. The bottom plate 106 is selectively raised to its sheet feed position or lowered to its retracted position by the drive means. When the bottom plate 106 is in the retracted position, the bottom plate 211 of the duplex unit 200 is in its refeed position. At the time of refeed from the duplex unit 200, the bottom plate 211 can be raised from below without resorting to exclusive pressing means.

The projection 211*a* extends from the underside of the bottom plate 211 and receives the force of the pressing mechanism associated with the bottom plate of the tray 100. Hence, when the pressing means assigned to the tray 100 is also used to press the bottom plate 211 in the event of refeed, the separators 210 of the duplex unit 200 and the separators 110 of the tray 100 are prevented from interfering with each other. In addition, the shared pressing means reduces the cost.

The separators 210 are so restricted as to rotate only upward. Therefore, if the separators 200 are held in their horizontal position and allowed to rotate only upward by, e.g., stop members, and if their ends are constantly lifted at the time of the shift of the sheet stack, i.e., except for the time of elevation of the bottom plate 211, the leading edge of the sheet stack can gets under the end 210*a* of the separator 210 with a greater margin. This further enhances the reliable shift of the sheet stack.

Figure 7:
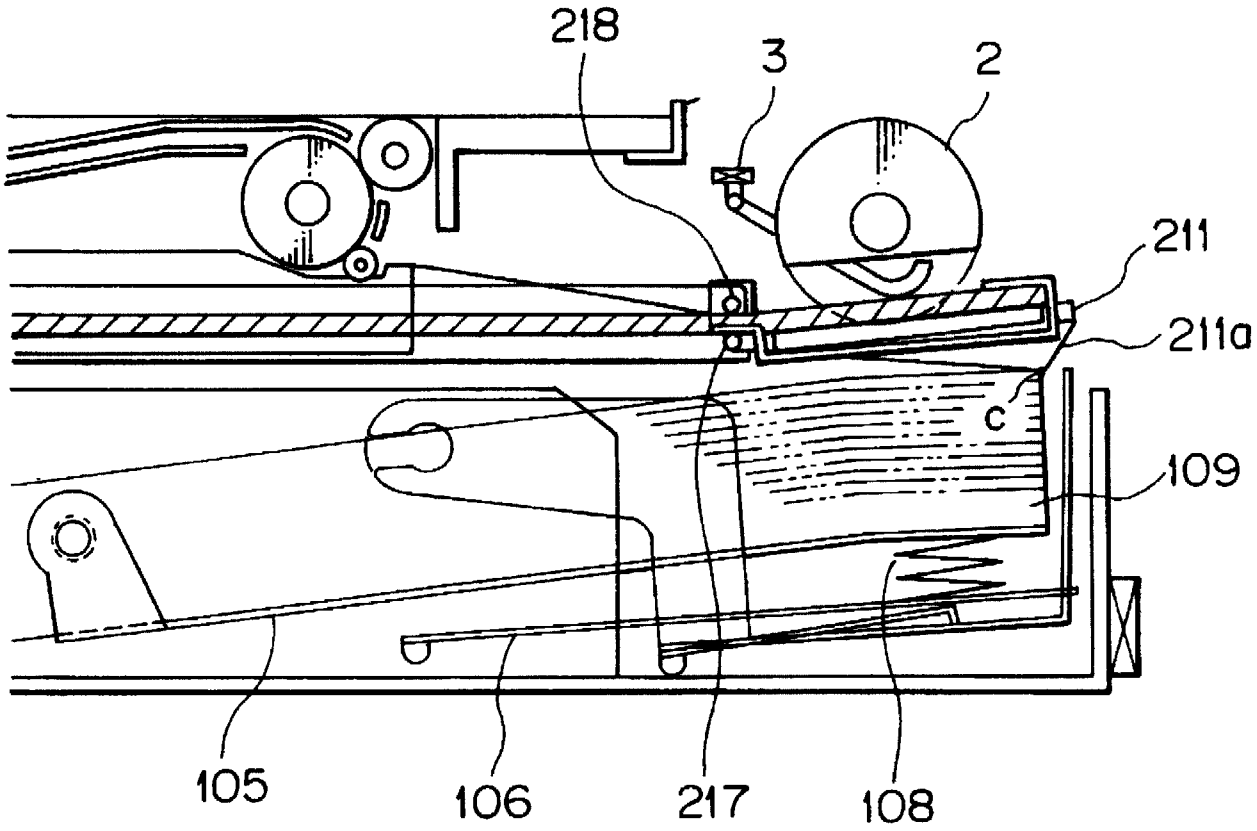
FIG. 7 shows how the sheets are refed from the duplex unit.

As shown in FIG. 7, in the above embodiment, the projection 211*a* of the bottom plate 211 and the sheet stack 109 of the sheet feed tray 100 abut against each other in the vicinity of the leading edge of the stack 109. In this configuration, when the bottom plates 105 and 106 are raised to raise the bottom plate 211 of the intermediate tray 200*a*, a lever is formed which has a point of force at the contact point c of the projection 211*a*, a fulcrum (point of action) at the shaft 217 of the bottom plate 211, and a point of action (fulcrum) at the point where the sheet stack 212 and pay-out roller 2 contact. The pressure based on the lever and acting on the projection 211*a* exerts an excessive force on the shaft 217 and roller 2, bending the bottom plate 211 and its support arm 215. In addition, the increase in friction at the shaft 217 and point c prevents the bottom plate 211 from moving smoothly when pressed. This makes it difficult to control the pressure and thereby renders the control over the pressure acting on the roller 2 unstable. In this condition, it is likely that the roller 2 feeds two or more sheets at a time, and the reliable sheet feed is not attainable.

A second embodiment of the present invention and its modifications free from the above problems will be described hereinafter.

2nd Embodiment

As shown in FIGS. 15–18, a bottom plate 221 is positioned in front of the intermediate tray 200*a* in order to support the leading edge of the sheet stack 212. The bottom plate 211 is movable back and forth in the refeed direction in order to bring the sheet stack 212 to the refeed position. The bottom plate 211 is rotatably connected to the intermediate tray 200*a* at its one end by a shaft 217. A projection 221*a* extends downward from the underside of the bottom plate 221. The projection 221*a* constitutes a presser portion for pressing the sheet stack 109 of the sheet feed tray 100. The projection 221*a* is positioned on a line L on which the pressure of the pay-out means 2 acts on the sheet stack 109 (solid line position shown in FIG. 15). In this case, the projection 221*a* contacts the sheet stack 109 at a point c located on the line L.

Figure 15:
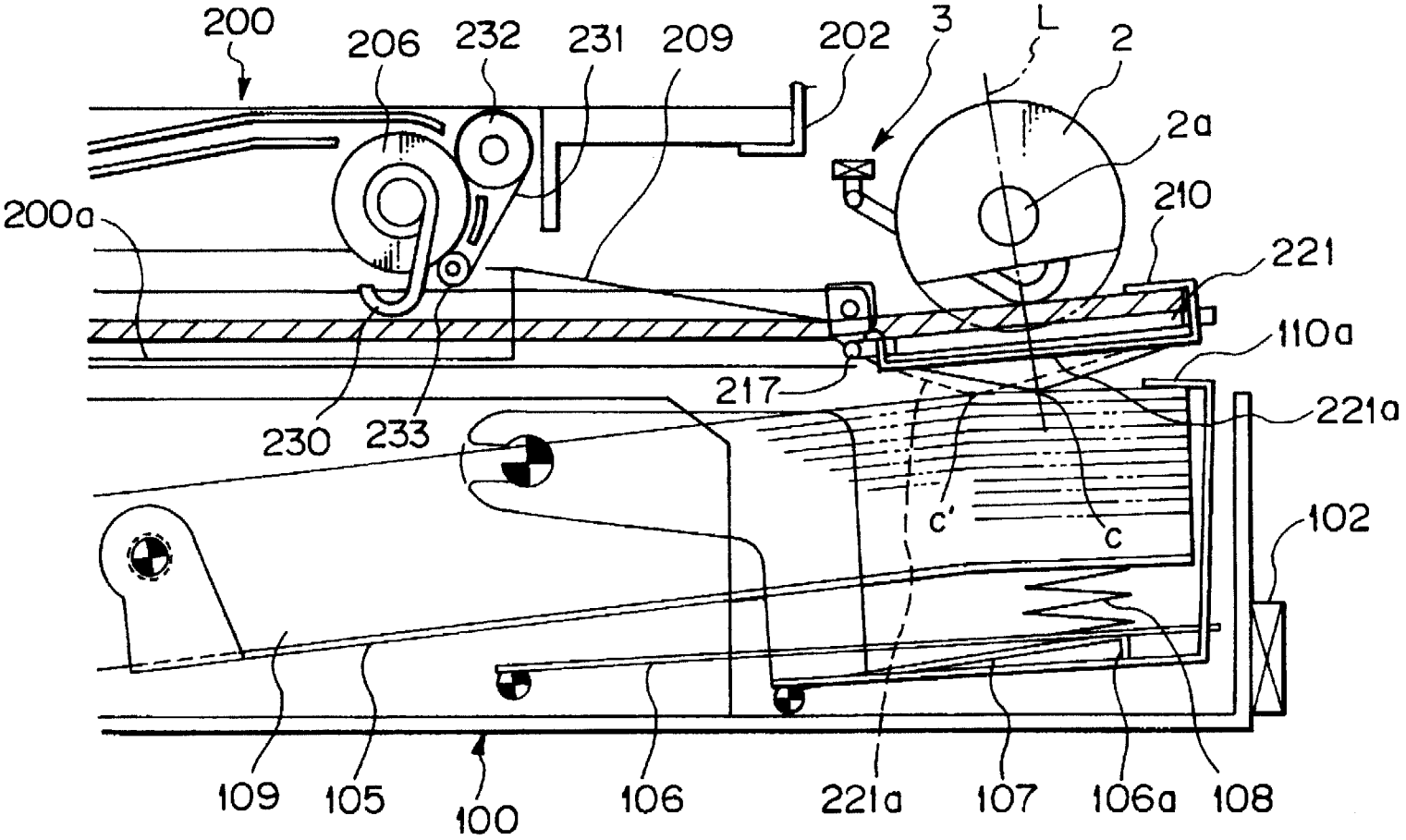
FIG. 15 is a fragmentary vertical section showing a second embodiment of the present invention.
Figure 16:
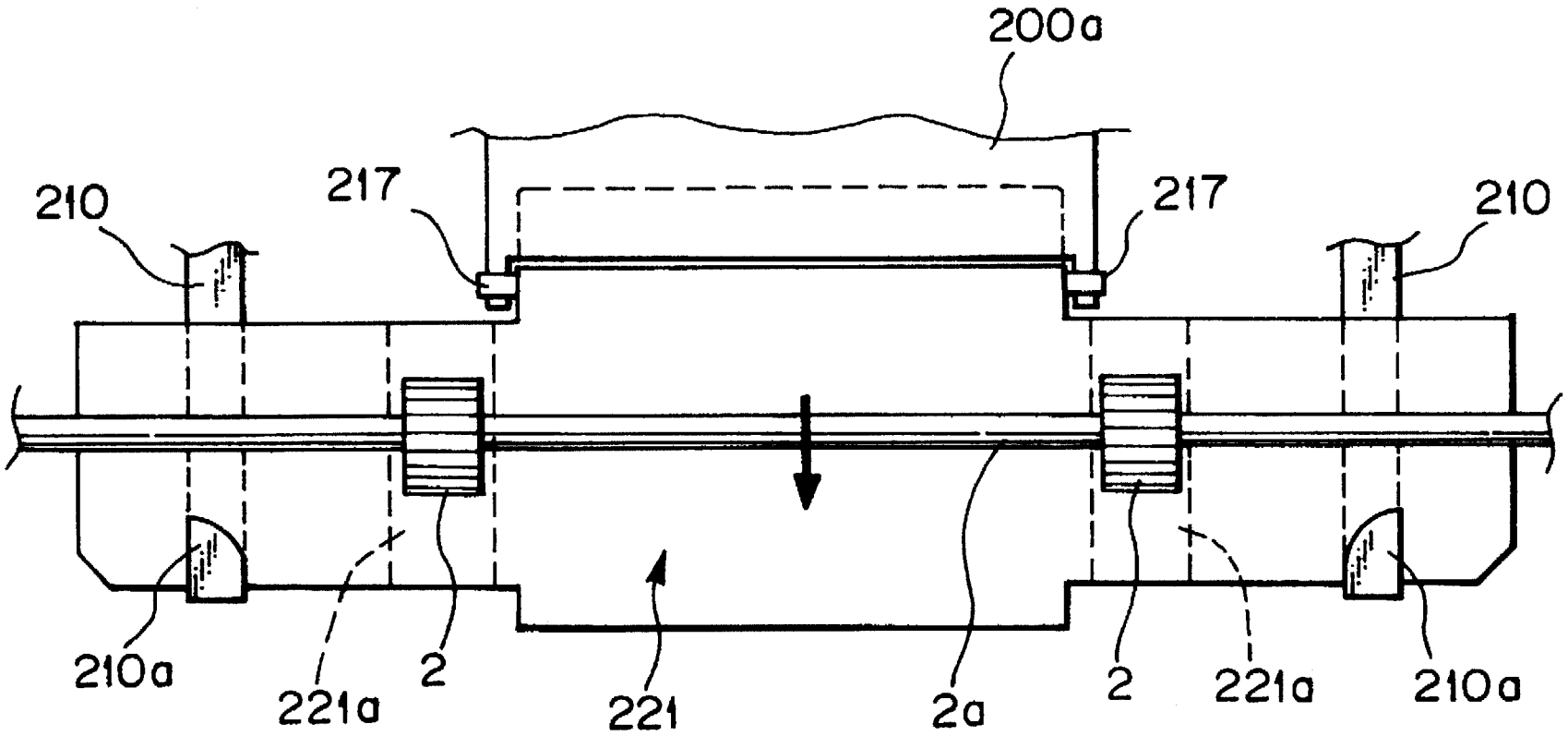
FIGS. 16 and 17 are respectively a fragmentary plan view and a front view of the second embodiment.
Figure 17:
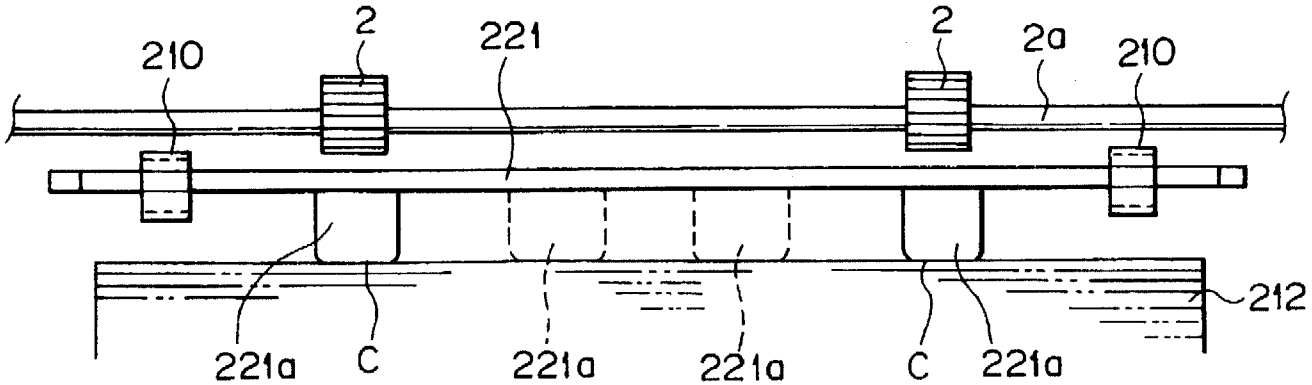

While the best result is achievable if the contact point c is located on the line L, the projection 221*a* may be shifted toward the shaft 217 of the bottom plate 221, as indicated by a dashed line in FIG. 15. In such a case, the projection 221*a* will contact the sheet stack 109 at a point c'.

A presser member 230 is received in a groove formed in the turn roller 206. Even if the sheet turned over by the turn roller 206 and entered the intermediate tray 200*a* is curled, the presser member 230 presses the trailing edge of the sheet. A belt 231 is passed over a drive roller 232 and an auxiliary roller 233. A number of grooves are formed in the outer periphery of the belt 231 in the widthwise direction. The belt 213 is held in pressing contact with the roller 206. Even if the trailing edge of the sheet entered the intermediate tray 200*a* is positioned in the vicinity of the roller 206 due to a curl, it can be surely moved to below and the right of the auxiliary roller 233 by being caught by the grooves of the belt 231.

As stated above, in the illustrative embodiment, the projection (presser portion) 221*a* extends out from the underside of the movable bottom plate 221 of the intermediate tray 200*a*. The projection 221*a* is positioned in the vicinity of the line L on which the force of the pay-out roller 2 acts on the sheet stack 109, or at a position adjoining the shaft 217 of the bottom plate 221. The sheet feed tray 100 and intermediate tray 200*a* can share a single pay-out roller 2. This reduces the number of structural elements and therefore the overall thickness of the device. In addition, the device does not need pick-up means or retracting means and is simple and inexpensive.

The pressure exerted by the first and second bottom plates 105 and 106 on the projection 221*a* is prevented from being increased or is even reduced when acting on the shaft 217 of the bottom plate 221 and pay-out roller 2. This frees the support arm of the bottom plate 221 from bending and excessive friction and allows the bottom plates 105 and 106 to raise the bottom plate 221 smoothly, thereby insuring smooth refeed. While the decrease in pressure obstructs sheet feed, it can be compensated for if the pay-out roller 2 is caused to exert a higher pressure on the sheet stack. This is rather desirable from the easy pressure control standpoint.

Because a single biasing means (108) is shared by the sheet feed tray 100 and duplex unit 200, the device is reduced in cost.

In the illustrative embodiment, the projection 221*a* and the contact point of the pay-out roller 2 are arranged in the direction perpendicular to line L and above the widthwise direction of the sheet stack. Therefore, the pressure of the first and second bottom plates 105 and 106 is directly transferred to the pay-out roller 2 and does not act on the shaft 217 of the bottom plate 221. Hence, the bottom plates 105 and 106 being raised are capable of raising the bottom plate 221 smoothly, so that the sheets can be surely fed.

Figure 18:
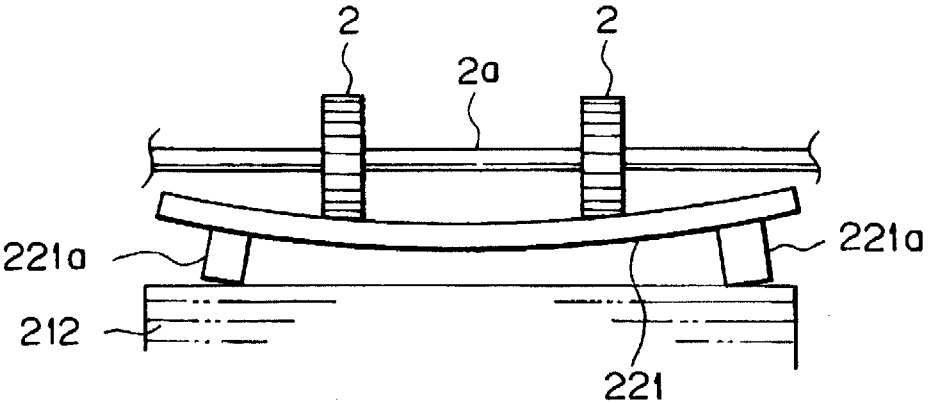
FIG. 18 is a view showing an undesirable occurrence.

The projection 221*a* is positioned beneath the pay-out roller 2. Should the roller 2 be positioned inward of the projection 221*a*, the bottom plate 221 might bend, as shown in FIG. 18 (should the roller 2 be positioned outward of the same, the plate 221 might warp in the opposite direction). The projection 221*a* positioned on the line L, as stated above, obviates a pressure loss ascribable to the deformation of the bottom plate 221.

Moreover, in the above embodiment, two or more projections 221*a* are formed on the bottom plate 221. In this configuration, the pressure is distributed and reduces the friction between each of them and the sheet stack 109. This further enhances the smooth rotation of the bottom plate 221 caused by the elevation of the bottom plates 105 and 106.

Figure 19:
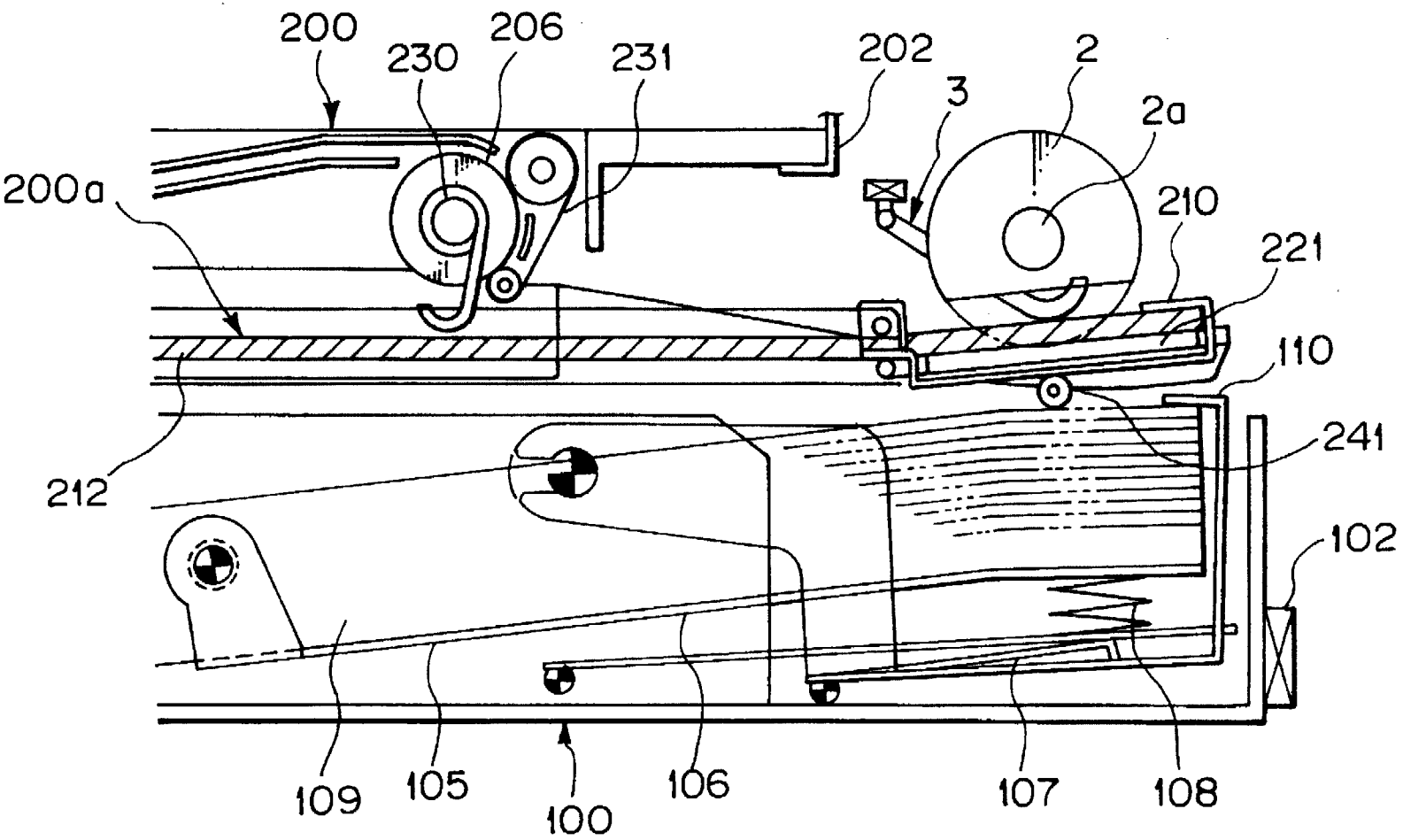
FIG. 19 is a fragmentary vertical section showing a first modification of the second embodiment.
Figure 20:
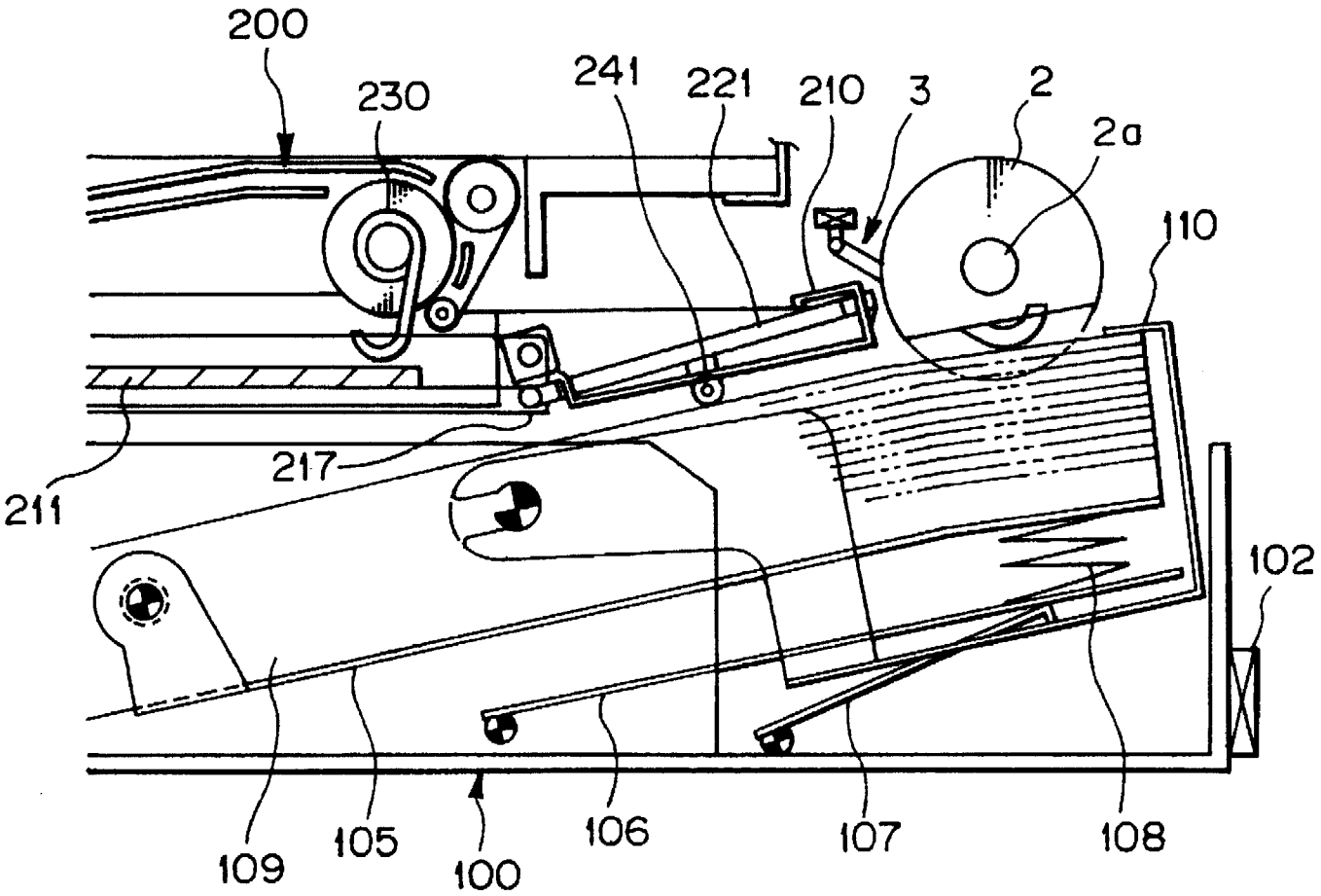
FIG. 20 shows the first modification in a sheet feed condition.

FIGS. 19 and 20 show a first modification of the second embodiment. As shown, the modification differs from the embodiment in that it includes a driven roller 241 in place of the projection or presser portion 221*a*. The driven roller 241 is rotatably mounted on the underside of the bottom plate 221 and contacts the top of the sheet stack 109 loaded on the sheet feed tray 100. However, the driven roller 241 rolls on the sheet stack 109, so that hardly any friction acts between the roller 241 and the sheet stack 109. This allows the bottom plate 221 to rotate smoothly, reduces the pressure loss, allows a small drive force to surely elevate the bottom plate 221, and allows the plate 221 to be smoothly lowered. In addition, friction between the pressure fulcrum occurring at the time of sheet feed from the tray 100 and the top of the sheet stack on the tray 100 is reduced, so that the device is free from misfeed.

Figure 21:
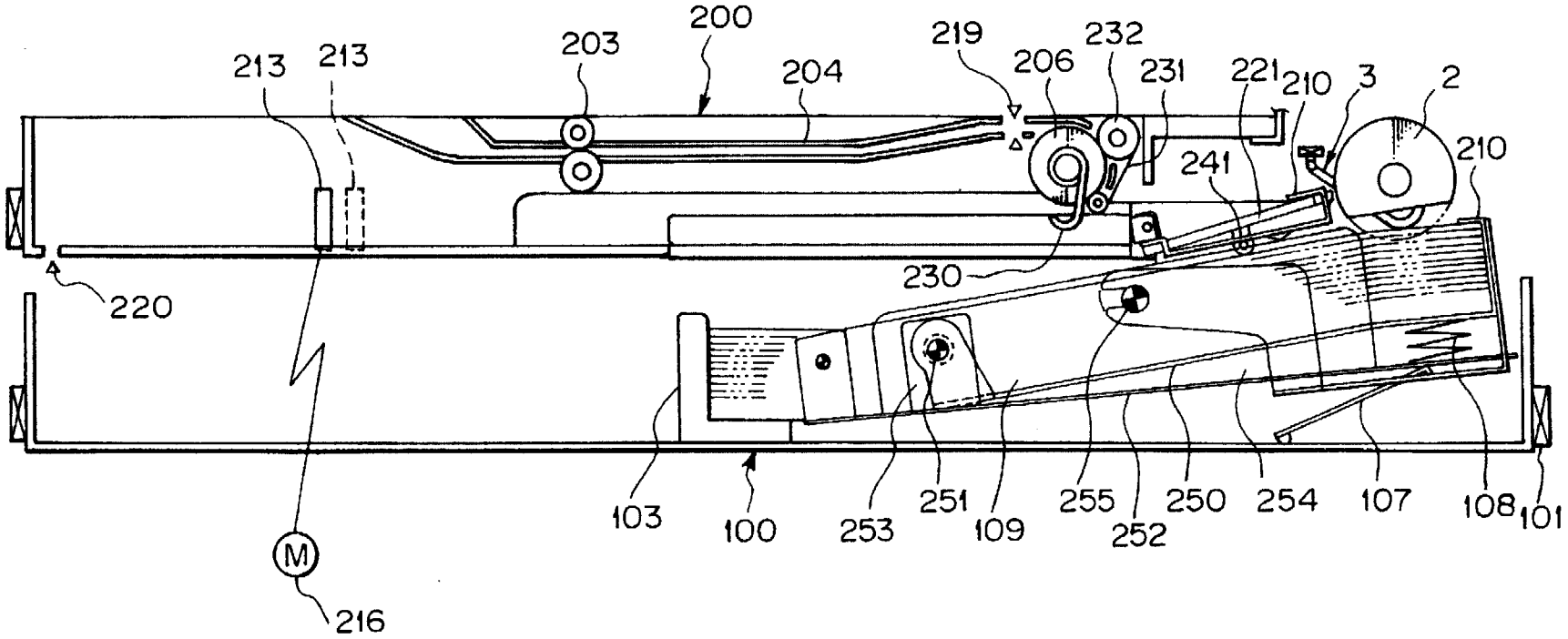
FIG. 21 is a vertical section showing a second modification of the second embodiment.

FIG. 21 shows a second modification of the second embodiment. Briefly, this modification differs from the second embodiment and its first modification in respect of the fulcrum of rotation of the first bottom plate 105. In the embodiment and its modification, the bottom plate 105 has a fulcrum of rotation on the sheet feed tray 100. This brings about a drawback that when the second bottom plate 106 is elevated, the right end of the bottom plate 105 sequentially moves away from the separators 110. It is therefore likely that the separators 110 fail to sufficiently retain the sheet stack 109, resulting in defective sheet separation and other troubles.

In light of the above, as shown in FIG. 21, a support 253 extends upright from the side edge of a second movable bottom plate 252. A first movable bottom plate 250 has a fulcrum of rotation 251 on the support 253. A side fence 254 is positioned at the side portion of the second bottom plate 252. The separator 110 also has a fulcrum of rotation 255 on the side fence 254. There are also shown in FIG. 21 the home position sensor 219 responsive to the home position of the end fence 213, and the sheet sensor 220. In the modification, even when the second bottom plate 252 is raised, the range which the side fence 254 covers the sheet stack and the positional relation between the side fence 254 and the separator 110 do not change at all. This successfully obviates skewing and thereby improves the sheet feeding ability of the device.

Figure 22:
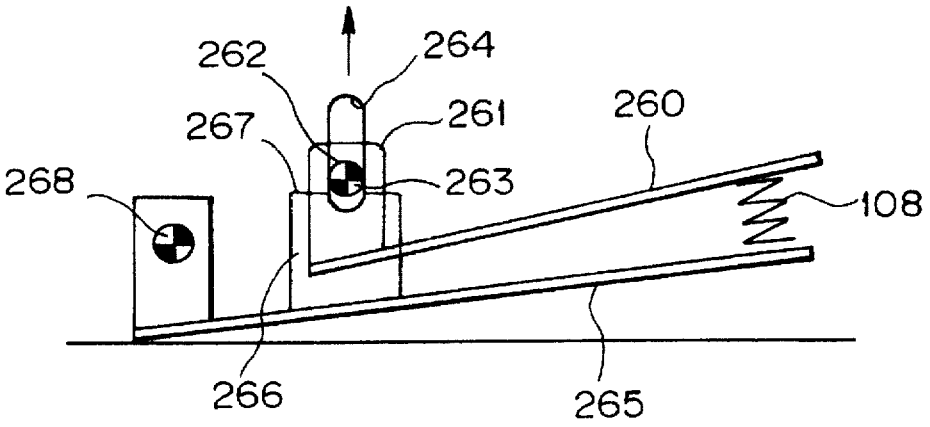
FIG. 22 is a fragmentary vertical section showing a third modification of the second embodiment.

FIG. 22 shows a third modification of the second embodiment. As shown, a first movable bottom plate 260 is supported by a support 261 formed with a circular hole 262. A shaft 263 is passed through the hole 262 and a vertically elongate slot 264 formed in the sheet feed tray 100. A support 266 extends upward from the side of a second movable bottom plate 265 and abuts against the shaft 263 at its top 267. The second bottom plate 265 includes a shaft 268 supported by the tray 100.

In the above configuration, when the bottom plate 265 is raised, it raises the end of the bottom plate 260 via the spring 108. The top 267 of the support 266 raises the shaft 263 along the slot 264 with the result that the fulcrum of rotation (263) of the bottom plate 260 is raised. At this instant, the fulcrum (273) is allowed to be movable only in the vertical direction due to the vertical slot 264. Therefore, even when the number of sheets is reduced, the inclination of the bottom plate 260 does not become sharp, and the relation between the plate 260 and the separator 110 does not change. This obviates the defective sheet separation and other troubles.

Of course, the modifications shown in FIGS. 21 and 22 are applicable to the above second embodiment and the first modification and achieves the above advantages.

As stated above, the second embodiment and its modifications have the following advantages.

(1) The sheet feed tray and intermediate tray share a single pay-out means. This reduces the number of structural elements and therefore the overall thickness of the device. In addition, the device does not need pick-up means or retracting means and is simple and inexpensive.

(2) The pressure exerted by the pay-out means is prevented from increasing when acting on the fulcrum of rotation of the bottom plate included in the intermediate tray. This frees the support arm of the bottom plate from bending and excessive friction and allows the pay-out roller to raise the bottom plate smoothly, thereby insuring smooth sheet feed.

(3) Because a single biasing means is shared by the sheet feed tray and duplex unit, the device is reduced in cost.

(4) The pressure of the pay-out roller is directly transferred to the bottom plate of the sheet feed tray via the presser portion and does not act on the fulcrum of rotation of the bottom plate of the intermediate tray. Hence, the pay-out roller can raise the bottom plate smoothly, so that the sheets can be surely fed.

(5) The projection positioned on the line L, as stated above, obviates a pressure loss ascribable to the deformation of the bottom plate 221. Therefore, the force can be directly applied.

(6) Two or more projections presser portions are formed on the bottom plate of the duplex unit. In this configuration, the pressure is distributed and reduces the friction between each of them and the sheet stack. This further enhances the smooth rotation of the bottom plate.

(7) Because the presser portion is rotatably supported, friction between the presser portion and the sheet stack is noticeably reduced. This enhances the smooth rotation of the bottom plate and reduces the pressure loss.

(8) Friction between the pressure fulcrum and the top of the sheet stack on the sheet feed tray is reduced when the sheets are fed from the sheet feed tray.

Figure 23:
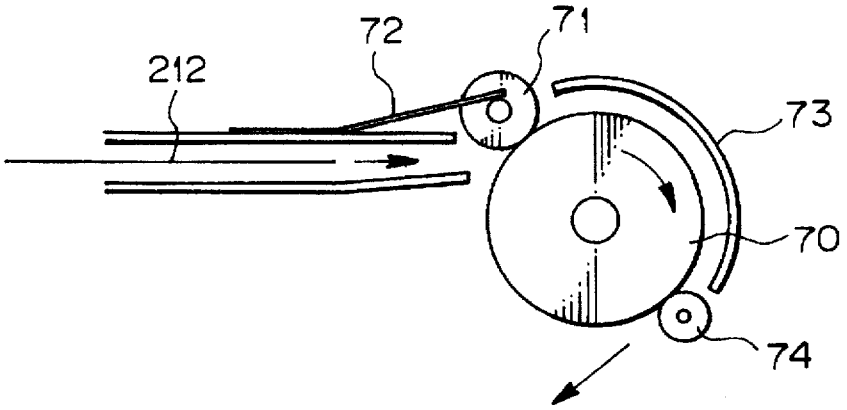
Fig. 23 PRIOR ART
FIG. 23 shows a turn-over section included in the duplex unit of a conventional duplex sheet feeding device.
Figure 24:
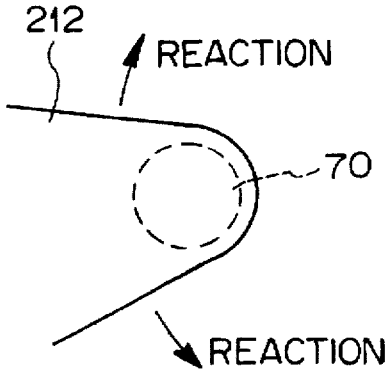
Fig. 24 PRIOR ART
FIG. 24 demonstrates the reaction of a sheet occurring at the turn-over section.
Figure 25:
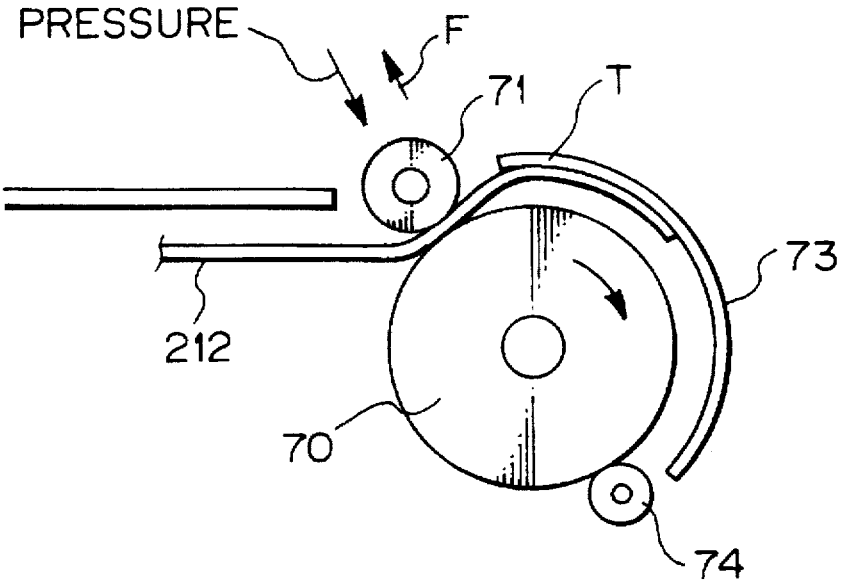
Fig. 25 PRIOR ART
FIG. 25 shows a condition wherein the leading edge of a sheet is conveyed to the turn-over section.
Figure 26:
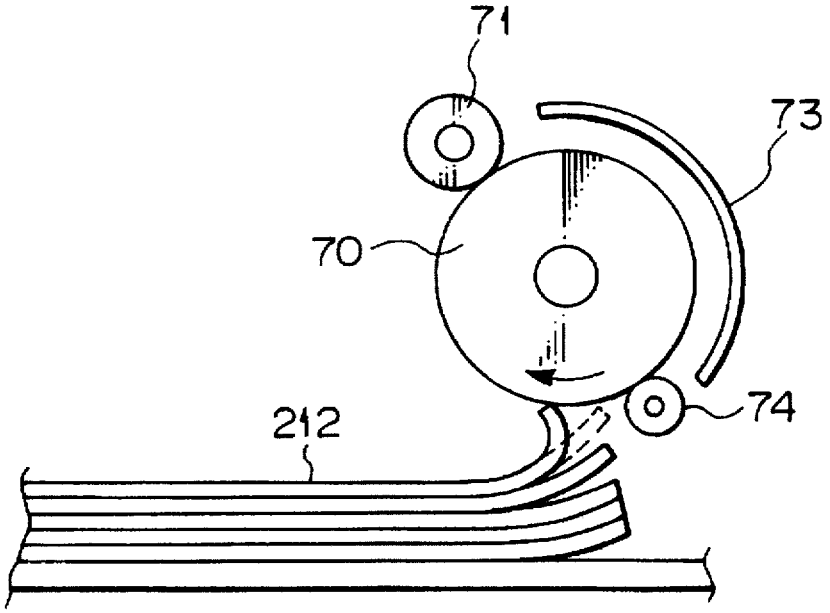
Fig. 26 PRIOR ART
FIG. 26 shows a turn roller and the trailing edge of a sheet.

In the first embodiment, the sheet 212 entering the intermediate tray 200*a* is turned over by the turn-over section and then stacked on the tray 200*a* with its opposite sides guided by guide members. It has been customary with a sheet feeding device to assign particular guide members for each sheet size. This, however, increases the number of structural elements. As shown in FIG. 23, it is a common practice with a sheet feeding device to hold a press roller 71 in pressing contact with a turn roller 70. In FIG. 23, there are also shown a guide plate 73 and an auxiliary roller 74. Further, as shown in FIG. 24, when the sheet 212 is turned over while being bent, it tends to restore to its original configuration. The reaction of the sheet 212 increases with an increase in the thickness of the sheet 212. In addition, as shown in FIG. 25, the conventional device has a problem that a bend T occurs due to friction acting between the leading edge of the sheet 212 being turned over and the guide plate 73. The elasticity of the sheet 212 causes a force F tending to push back the press roller 71 to act in the opposite direction to the pressure of the spring 72. As a result, the pressure of the roller 71 acting on the sheet 212 is not intense enough to obviate the loss of the conveying force. The loss cannot be eliminated unless the pressure is increased. This is particularly true when the sheet 212 is thick. FIG. 26 shows the turn roller 70 and the trailing edges of the sheets 212.

Hereinafter will be described a third embodiment and its modifications capable of solving the above problems.

3rd Embodiment

Figure 27:
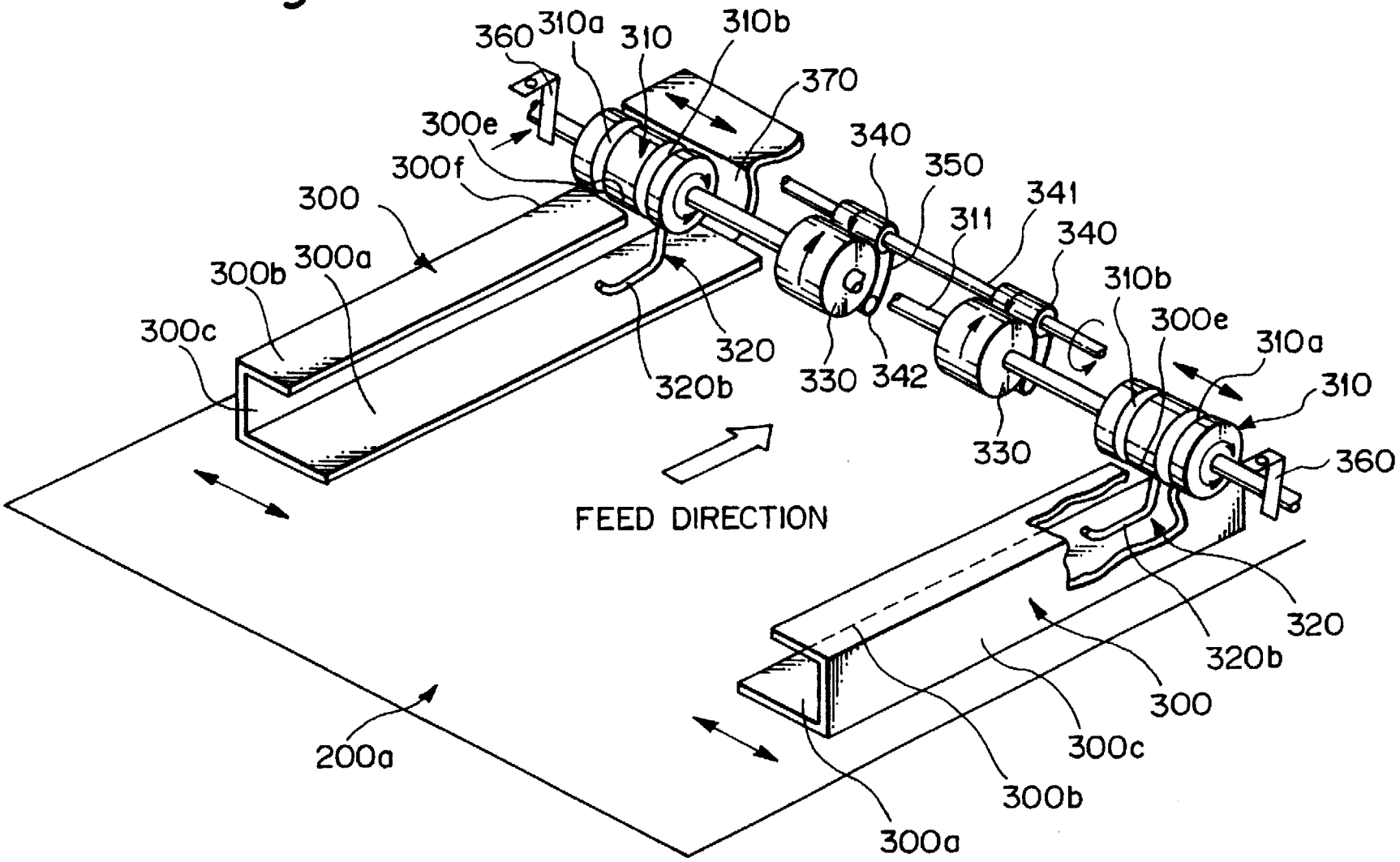
FIG. 27 is a fragmentary perspective view showing a third embodiment of the present invention.

A third embodiment will be described with reference to FIGS. 27–42. As shown in FIG. 27, the intermediate tray 200*a* includes side fences 300 slidable toward and away from each other in the widthwise direction of sheets. Each side fence 300 has a bottom portion 300*a* on which one side edge portion of the sheet 212 will lie, a top portion 300*b* to lie above the side edge portion of the sheet 212, a side portion 300*c* connecting the bottom portion 300*a* and top portion 300*b*, a notch 300*e* formed in the top portion 300*b*, and an engaging portion 300*f*. The side portion 300*c* plays the role of a jogger on abutting against the side edge of the sheet 212. A cylindrical turn guide roller 310 is positioned in the notch 300*e* and so engaged with the engaging portion 300*f* as to follow the side fence 300.

Figure 40:
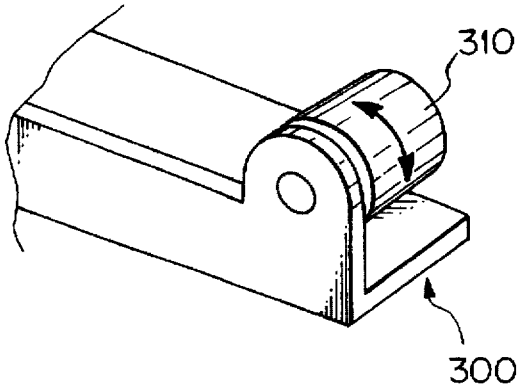
FIG. 40 is a perspective view showing an alternative configuration of a guide roller.

The intermediate tray 200*a* includes a turn guide plate 370 spaced a predetermined distance from the turn guide roller 310. As shown in FIG. 27, a shaft 311 extends throughout the turn guide rollers 310. The rollers 310 are freely rotatable on the shaft 311 and slidable in the axial direction of the shaft 311. If desired, the rollers 310 may each be directly journalled to the associated side fence 300, as shown in FIG. 40, or may not be rotatable.

As stated above, in this embodiment, the side fences 300 are mounted on the intermediate tray 200*a*, and each includes the turn guide member (roller 310) for guiding the adjoining edge of the sheet 212. The guide members 310 guide the inner surface of the sheet 212 being turned over at the turn-over section. Therefore, even when the sheet 212 entering the intermediate tray 200*a* has a curl, its opposite side edges can be surely guided into the tray 200*a*. This is particularly true when the turn-over section has a small diameter.

When the turn guide members are implemented as the guide rollers 310, they are rotated by the sheet 212 being turned over. As a result, the resistance acting between the sheet 212 and the guide rollers 310 is reduced. This obviates sheet jams and the required conveying force.

The guide rollers 310 are slidable, following the movement of the side fences 300. Therefore, when the side fences 300 are moved in accordance with the size of the sheets 212, the guide rollers 310 are automatically brought into contact with the side edges of the sheets 212. Consequently, the guide rollers 310 are capable of surely guiding the side edges of the sheets 212 without regard to the sheet size. This reduces the number of structural elements.

The guide rollers 310 are each formed with an annular groove 310*a* in its circumference. The side fences 300 are each received in the respective groove 310*a*. In this condition, despite that the guide rollers 310 are caused to follow the movement of the side fences 300, they can slide and rotate smoothly.

Figure 28:
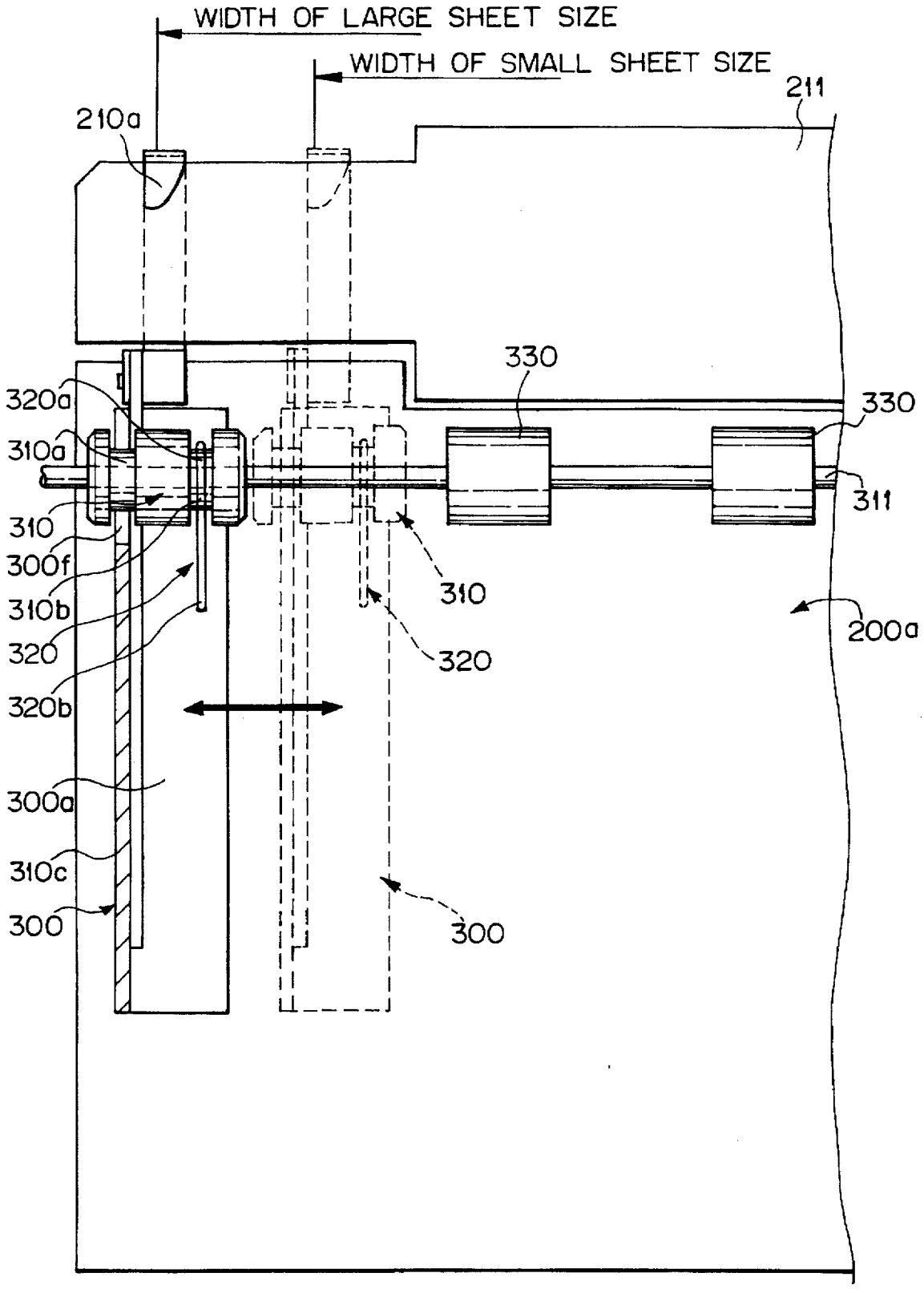
FIG. 28 is a plan view demonstrating the operation of a side fence included in the third embodiment.

Specifically, as shown in FIG. 28, the annular grooves 310*a* are each formed in the axially outer portion of the respective guide roller 310. The engaging portions 300*f* of the side fences 300 are respectively received in the grooves 310. When the side fences 300 slide toward or away from each other, they cause the guide rollers 310 to move along the shaft 311 via the engaging portions 300*f* and grooves 310*a*. In FIG. 28, positions indicated by solid lines correspond to a great sheet size while those indicated by dashed lines correspond to a small sheet size.

Figure 29:
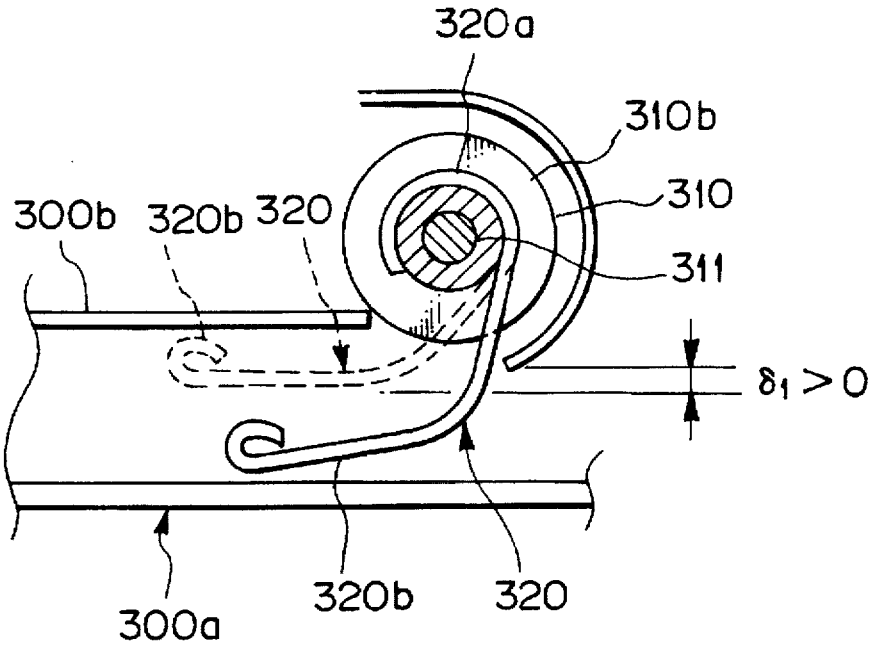
FIG. 29 shows a presser member also included in the third embodiment together with members associated therewith.

As shown in FIGS. 27–29, the guide rollers 310 are each formed with another annular groove 310*b* in its axially inner portion. Presser members 320 are respectively rotatably positioned in the grooves 310*b*. Specifically, each presser member 320 has a ring portion 320*a* complementary to the bottom of the recess 310*b* at one end. The ring portion 320*a* is received in the groove 310*b*, so that the presser member 320 is rotatable. The other end of the presser member 320 is implemented as a pressing portion 320*b* extending out from the groove 310*b* in the direction in which the sheet 212 enters the intermediate tray 200*a*. The presser member 320*b* may be provided with any suitable configuration, e.g., one shown in FIG. 27 or 29. The crux is that the presser member 320 has the ring portion 320*a* and the pressing portion 320*b* extending in the above direction and has the end of the pressing portion bent upward so as not to catch the sheet stack being shifted.

The pressing portion 320*b* of each presser member 320 is positioned above the bottom portion 300*a* of the associated side fence 300. Therefore, even when the trailing edge of the sheet 212 entered the intermediate tray 200*a* has a curl, the pressing portion 320 successfully presses it and thereby enhances accurate stacking of the sheet on the tray 200*a*.

The presser member 320 rotatably positioned in the respective groove 310*b* does not interfere with the sheet 212 entering via the turn-over section and is compact. Because the presser member 320 is mounted on the respective guide roller 310, it can be surely positioned at and press the adjoining side edge of the sheet 212. In addition, the presser member 320 is rotatable as the number of sheets 212 stacked on the intermediate tray 200*a* increases.

As indicated by a dotted line in FIG. 29, the top portion 300*b* of each side fence 300 plays the role of a stop for limiting the elevation of the end of the associated presser member 320. The best result is achievable when the stop 300*b* is positioned at a level lower than the the lower end of the turn-over guide plate ($\delta_1>0$). If desired, the stop may be implemented as a separate member, as shown in FIG. 29. When the sheets 212 each having a curl are sequentially stacked on the intermediate tray 200*a*, the stops limiting the elevation of the presser members 320 delimit the space. Hence, when the sheet stack 212 on the tray 200*a* is shifted to the refeed position in the event of refeed, the top of the sheet stack 212 is prevented from contacting, e.g., the turn-over guide plate disposed above the stack 212. This insures the smooth shift of the sheet stack 212 to the refeed position.

Turn rollers 330 are rotatably mounted on the intermediate portion of the shaft 311. Drive rollers 340 are mounted on a drive shaft 341 and positioned in the vicinity of and above the turn rollers 330, respectively. Auxiliary rollers 342 are rotatably supported at positions adjoining and below the turn rollers 330, respectively. A turn belt 350 is passed over each drive roller 340 and associated auxiliary roller 342. The outer surface of the belt 350 is partly pressed against the associated turn roller 330.

The drive rollers 340, turn belts 350 and auxiliary rollers 342 constitute the drive side of the turn-over section while the turn rollers 330 constitute the driven section of the same. In this condition, at the inlet and outlet of the turn-over section, the reaction of the sheet 212 bent along the turn rollers 330 acts in such a manner as to urge the sheet 212 against the turn belts 330. Further, at the portion between the inlet and the outlet, the sheet 212 is pressed against the turn rollers 330. As a result, the sheet 212 is surely conveyed by the belts 350 and turn rollers 330 while being pressed against them. Even when the sheet 212 is curled or relatively thick, the conveyance is free from losses and needs a minimum of pressure.

Figure 41:
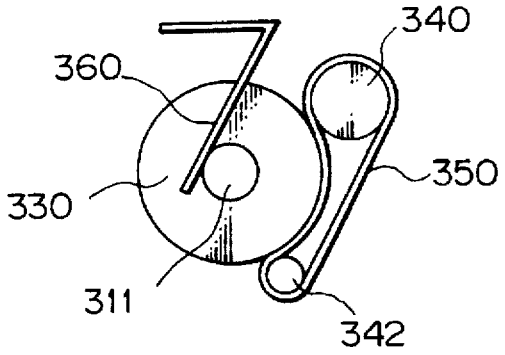
FIG. 41 shows a specific mechanism for pressing a shaft on which a guide roller is mounted.
Figure 42:
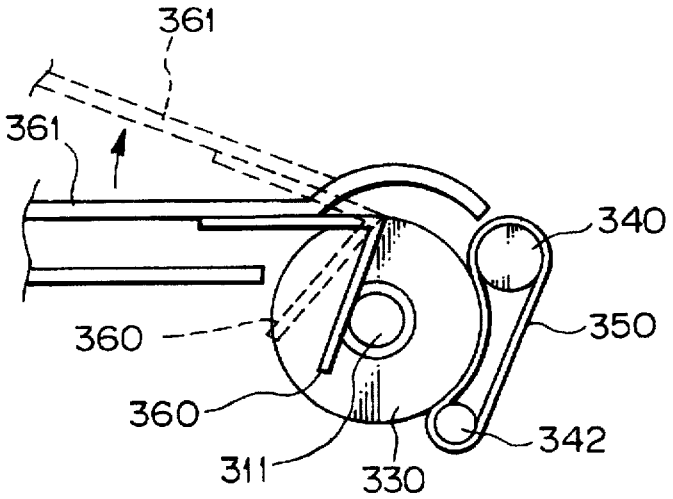
FIG. 42 shows another specific configuration of the mechanism for pressing the shaft of the guide roller.

As shown in FIGS. 27 and 41, the shaft 311 is constantly biased by leaf springs 360 such that the turn rollers 330 are pressed against the turn belts 350. Alternatively, as shown in FIG. 42, the leaf springs 360 may be mounted on a guide member 361 such that when the guide plate 361 is opened, the leaf springs 360 are released from the shaft 311. This will failitate the removal of a jamming sheet.

The turn belts 350 are formed of rubber or similar high friction material, and each is formed with a number of spaced ridges 351 in its widthwise direction. Even if the trailing edge of the sheet 212 entered the intermediate tray 200*a* is positioned in the vicinity of the turn rollers 330 due to a curl, it can be surely moved to below and the right of the auxiliary roller 342 by being caught by the ridges 351 of the belt 231.

Figure 32:
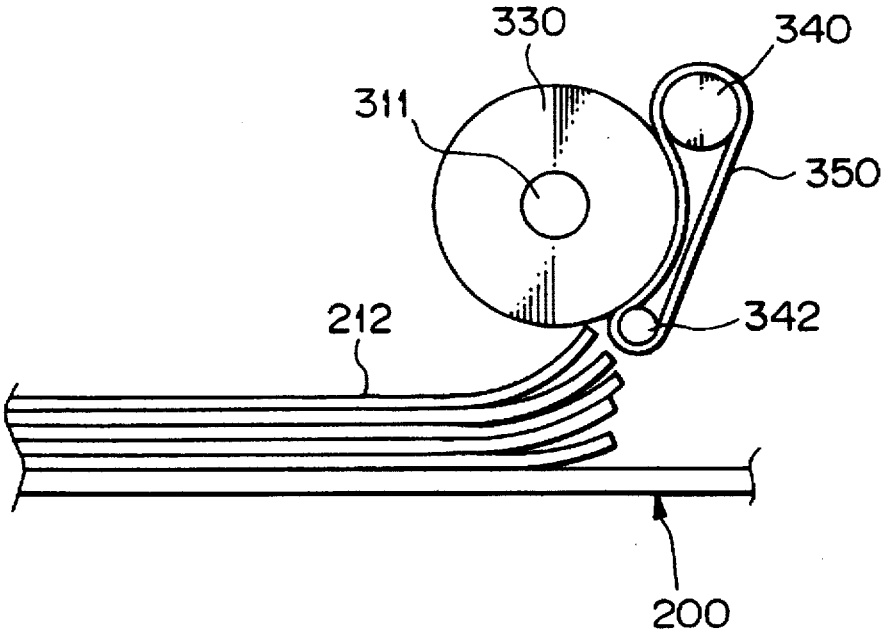

The turn rollers 330 may be formed of resin or similar material having a small coefficient of friction against sheets. Then, as shown in FIG. 32, even if the curled edge of the sheet 212 is in contact with the turn rollers 330, it simply slips and drops. Moreover, such turn rollers 330 eliminate the need for presser members and thereby reduces the number of constituent parts. As a result, the turn rollers 330 can be brought closer to the sheet stack, i.e., the space (height) above the sheet stack can be reduced in order to reduce the overall thickness and size of the duplex unit 200.

Figure 33:
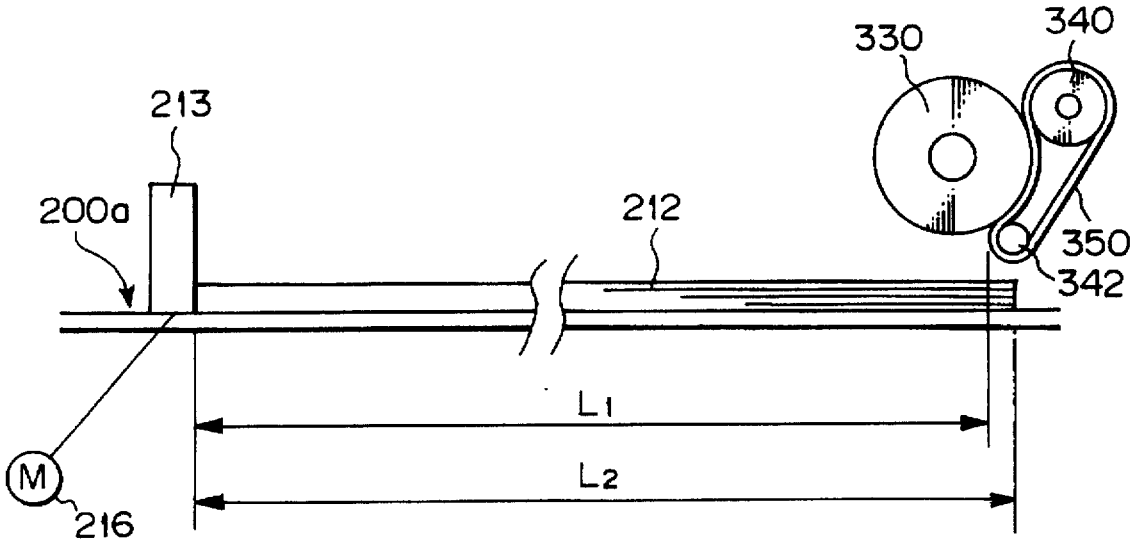
FIG. 33 shows a relation between a sheet, the end fence, and the turn-over section.
Figure 34:
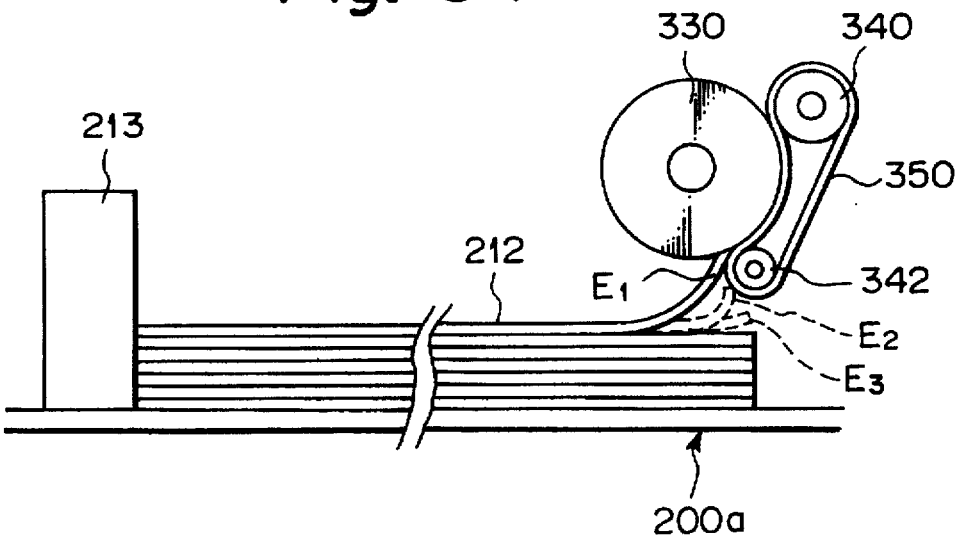
FIG. 34 shows the sheet and turn-over section based on the relation shown in FIG. 33.
Figure 36A:
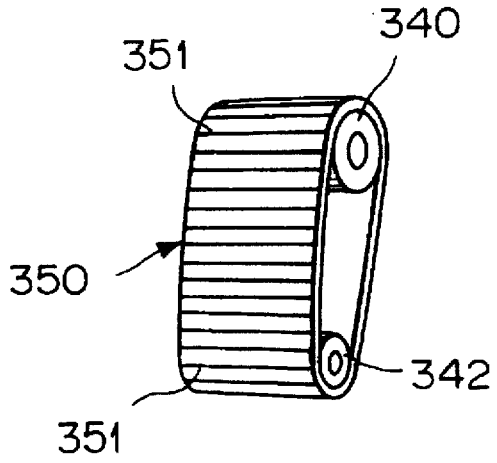
FIGS. 36A and 36B show a turn-over belt in a condition not contacting a turn-over roller.
Figure 36B:
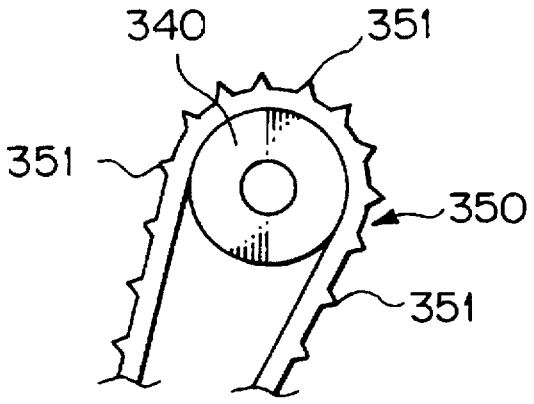

As shown in FIG. 33, the movable end fence 213 is mounted on the intermediate tray 200*a*. The distance $L_1$ between the end fence 213 and the auxiliary rollers 342 is selected to be smaller than the length $L_2$ of the sheet 212. Therefore, as shown in FIG. 34, the sheet 212 entered the tray 200*a* has its leading edge stopped by the end fence 213 and has its trailing edge $E_1$ moved from a position $E_2$ to a position $E_3$ along the auxiliary rollers 342 by the turn belts 350. This prevents the trailing edge of the sheet stack 212 from contacting the auxiliary rollers 342 when shifted to the refeed position. As shown in FIGS. 36A and 36B, the ridges 351 provided on the outer surface of each turn belt 350 further enhance the above effect.

Figure 35:
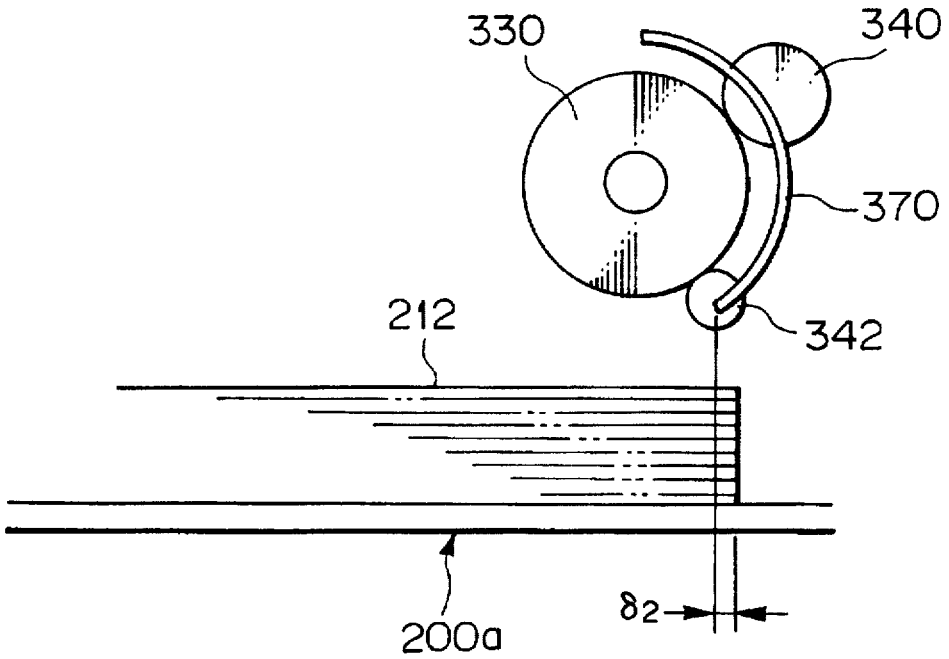
FIG. 35 shows a relation between the trailing edge of a sheet, an auxiliary roller, and a turn-over guide plate.

As shown in FIG. 35, the best result is achievable when the distance $L_1$ is selected such that the distance $\delta_2$ between the lower end of the turn guide plate 370 and the trailing edge of the sheet stack 212 is greater than zero. If the auxiliary rollers 342 and the end of the turn guide plate 370 are so positioned, the sheet 212 can be prevented from remaining on the guide plate 370 or from contacting the guide plate 370 when it has a curl.

Figure 37:
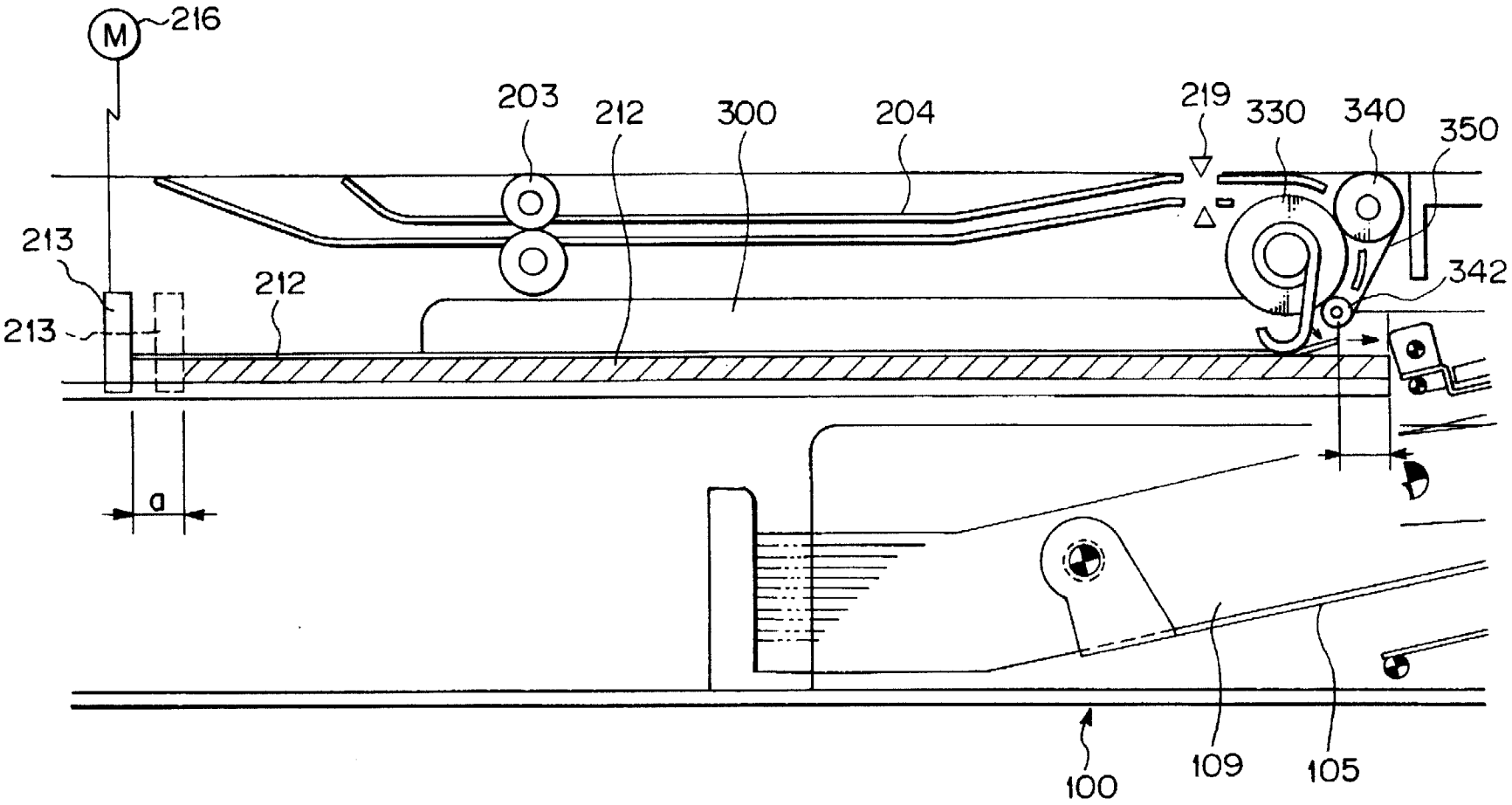
FIG. 37 demonstrates the operation of the end fence.
Figure 38:
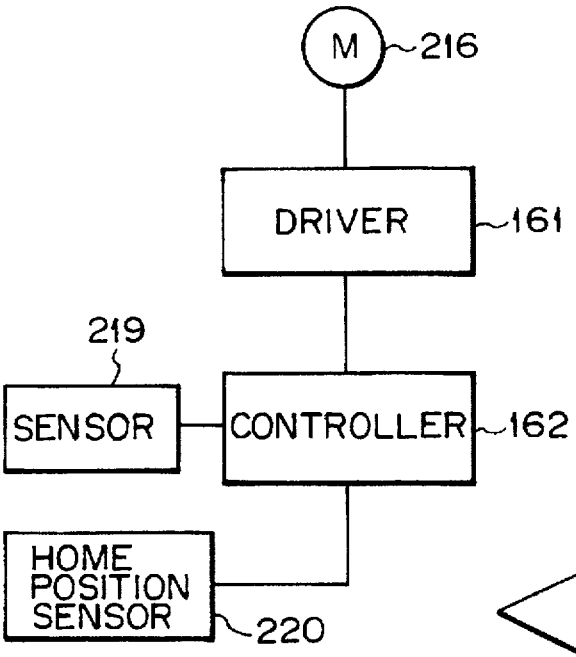
FIG. 38 is a block diagram schematically showing an arrangement for controlling the operation of the end fence.

A reference will be made to FIGS. 37–39 for describing the control over the movable end fence 213 to be executed on the entry of the sheet 212 in the intermediate tray 200*a*. In FIG. 38, there are shown the motor 216 for driving the end fence 213, a motor driver 161 for driving the motor 216, and a microcomputer or controller 162 for controlling the driver 161. Connected to the controller 162 are the sheet sensor 219 adjoining the inlet of the turn-over section, and the home position sensor responsive to the home position of the end fence 213.

Figure 39:
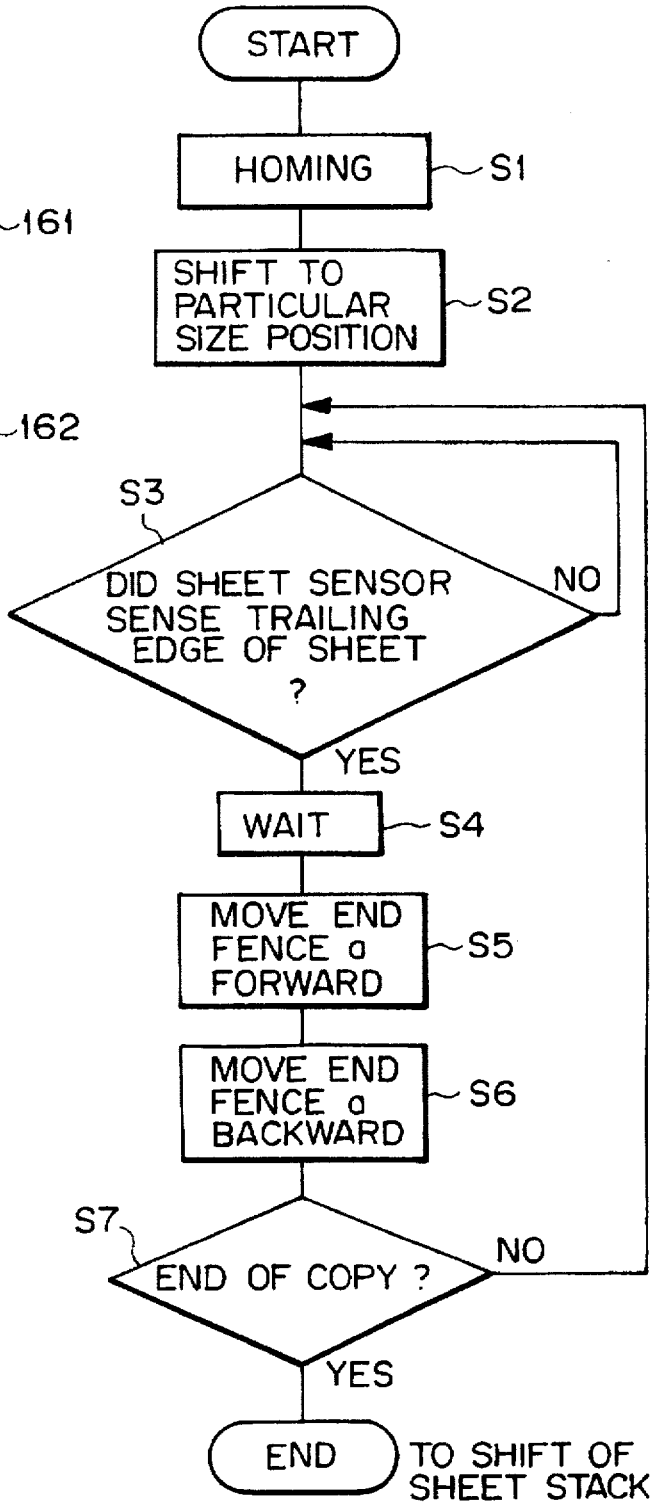
FIG. 39 is a flowchart representative of a specific operation of a controller included in the arrangement of FIG. 38.

As shown in FIG. 39, the end fence 213 is returned to its home position (step S1). For this purpose, the controller 162 causes the motor driver 161 to drive the motor 216 until the home position sensor 220 senses the end fence 213. Then, the controller 162 causes, based on sheet size information entered on an operation panel, the motor driver 161 to drive the motor 216 for thereby moving the end fence (step S2). In this condition, the end fence 213 is brought to the position indicated by a solid line in FIG. 37.

The sheet 212 fed from the image forming section is conveyed by the conveyor rollers toward the turn-over section and then turned over by the turn rollers and turn belts. After the sheet sensor 219 has sensed the trailing edge of the sheet 212 entering the intermediate tray 200*a* (YES, step S3), the controller 162 waits until the sheet 212 has been surely discharged into the tray 200*a* (step S4). As a result, the leading edge of the sheet 212 is brought into abutment against the end fence 213. Subsequently, the controller 162 causes the end fence 213 to move forward (toward the refeed position) a distance a (step S5) while moving the sheet 212 by the distance a. This brings the fight edge of the sheet 212 to the position below and rightward of the auxiliary rollers 342. Then, the controller 162 causes the end fence 213 to move the distance a backward (step S6), leaving the sheet 212 at the advanced position.

If the copying operation is continued (NO, step S7), the controller 162 repeats the above steps S3 through S7. That is, the above procedure is repeated every time the one-sided sheet 212 enters the tray 200*a*.

Figure 30:
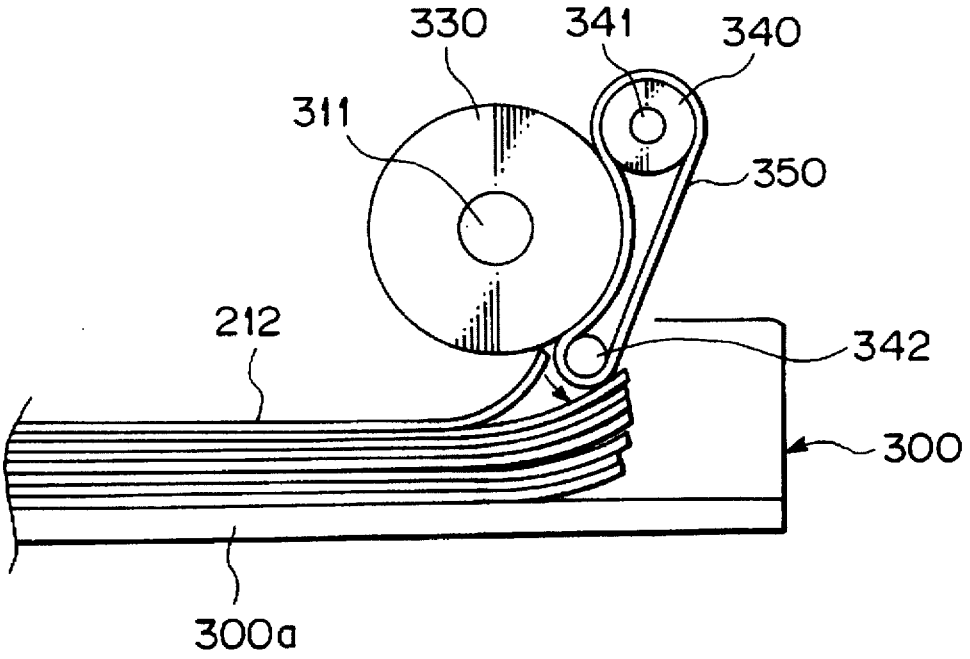
FIGS. 30, 31 and 32 each shows a relation between a turn-over section, and the trailing edge of a sheet.
Figure 31:
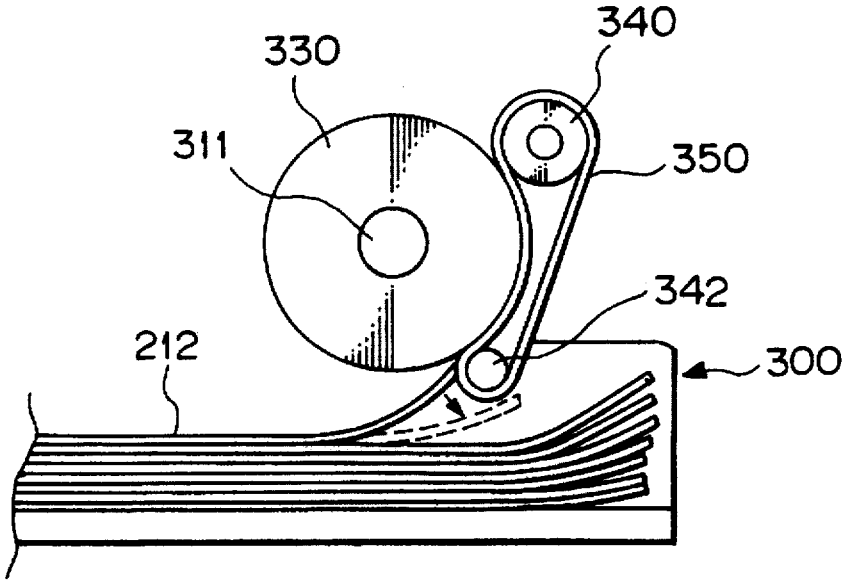

Despite the arrangement shown in FIGS. 33–35, as the number of sheets 212 stacked on the intermediate tray 200*a* increases, the trailing edge of the sheet 212 contacts the auxiliary rollers 342 if it is noticeably curled, as shown in FIG. 30. As a result, despite that a sufficient space is available at the portion other than the curled portion, the following sheet 212 cannot have its trailing edge positioned below the auxiliary rollers 342. This problem can be solved by the above procedure. Specifically, the sheets 212 are shifted forward beforehand, so that the space below the auxiliary rollers is open at all times. Therefore, as shown in FIG. 31, even if the curled trailing edge of the sheet 212 is as high as the auxiliary rollers 342, the trailing edge of the following sheet 212 can be positioned below the auxiliary rollers 342.

As stated above, every time the sheet 212 is introduced into the tray 200*a* via the turn-over section, the controller 162 causes it to be shifted toward the refeed position away from the outlet portion of the turn-over section. Therefore, the curled portion of the sheet 212 is prevented from contacting the turn-over section in the event of refeed while the leading edge of the following sheet is prevented from being blocked by the curled portion of the preceding sheet. In addition, the trailing edge of the sheet 212 can be positioned below the auxiliary rollers 342 without regard to the height of its curl. In this manner, the sheets 212 each having a curl can be desirably stacked on the tray 200*a*.

The general construction of the above duplex sheet feeding device will be described with reference to FIG. 43. As shown, the movable bottom plate 221 is located in front of the intermediate tray 200*a* and movable to shift the sheet stack 212 in the refeed direction while supporting its leading edge. The bottom plate 221 is supported by the shaft 217 rotatably relative to the tray 200*a* at its one end. The projection 221*a* extends downward from the underside of the bottom plate 221. The projection 221*a* constitutes a presser portion for pressing the sheet stack 109 of the sheet feed tray 100. The projection 221*a* is positioned on the line L on which the pressure of the pay-out means 2 acts on the sheet stack 109 (solid line position shown in FIG. 43). In this case, the projection 221*a* contacts the sheet stack 109 at the point c located on the line L.

Figure 43:
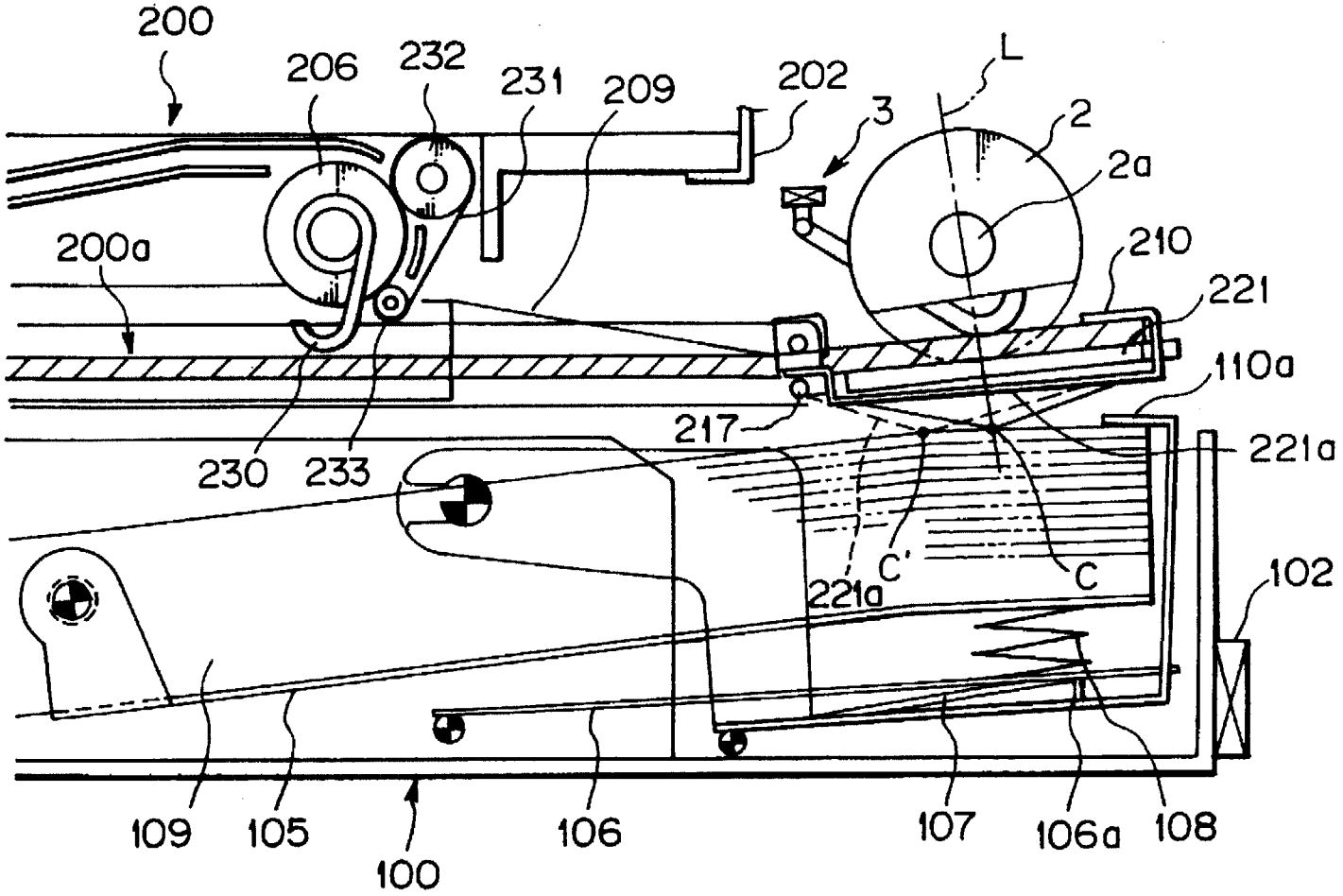
FIG. 43 is a fragmentary vertical section showing the general construction of the third embodiment.

While the best result is achievable if the contact point c is located on the line L, the projection 221*a* may be shifted toward the shaft 217 of the bottom plate 221, as indicated by a dashed line in FIG. 43. In such a case, the projection 221*a* will contact the sheet stack 109 at a point c'.

Figure 44:
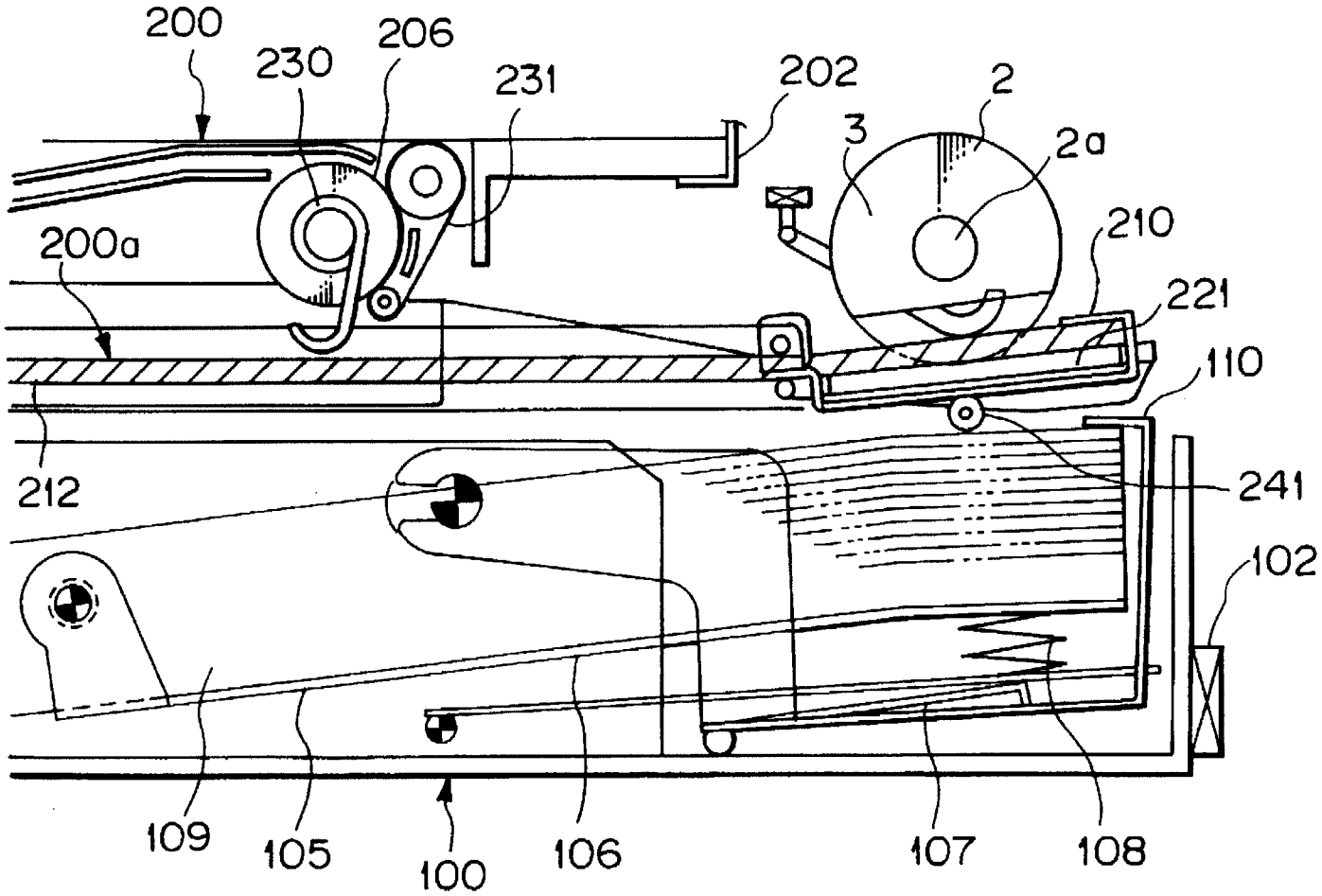
FIG. 44 is a fragmentary vertical section showing a first modification of the third embodiment.

FIG. 44 shows a first modification of the third embodiment. As shown, the driven roller 241 is substituted for the projection or presser portion 221*a*. The driven roller 241 is rotatably mounted on the underside of the bottom plate 221 and contacts the top of the sheet stack 109 loaded on the sheet feed tray 100. However, the driven roller 241 rolls on the sheet stack 109, so that hardly any friction acts between the roller 241 and the sheet stack 109. This allows the bottom plate 221 to rotate smoothly, reduces the pressure loss, allows a small drive force to surely elevate the bottom plate 221, and allows the plate 221 to be smoothly lowered. In addition, friction between the pressure fulcrum occurring at the time of sheet feed from the tray 100 and the top of the sheet stack on the tray 100 is reduced, so that the device is free from misfeed.

The sheet feed tray 100 and intermediate tray 200*a* can share a single pay-out roller 2. This reduces the number of structural elements and therefore the overall thickness of the device. In addition, the device does not need pick-up means or retracting means and is simple and inexpensive.

The pressure exerted by the first and second bottom plates 105 and 106 on the projection 221*a* is prevented from being increased or is even reduced when acting on the shaft 217 of the bottom plate 221 and pay-out roller 2. This frees the support arm of the bottom plate 221 from bending and excessive friction and allows the bottom plates 105 and 106 to raise the bottom plate 221 smoothly, thereby insuring smooth refeed. While the decrease in pressure obstructs sheet feed, it can be compensated for if the pay-out roller 2 is caused to exert a higher pressure on the sheet stack. This is rather desirable from the easy pressure control standpoint.

Figure 45:
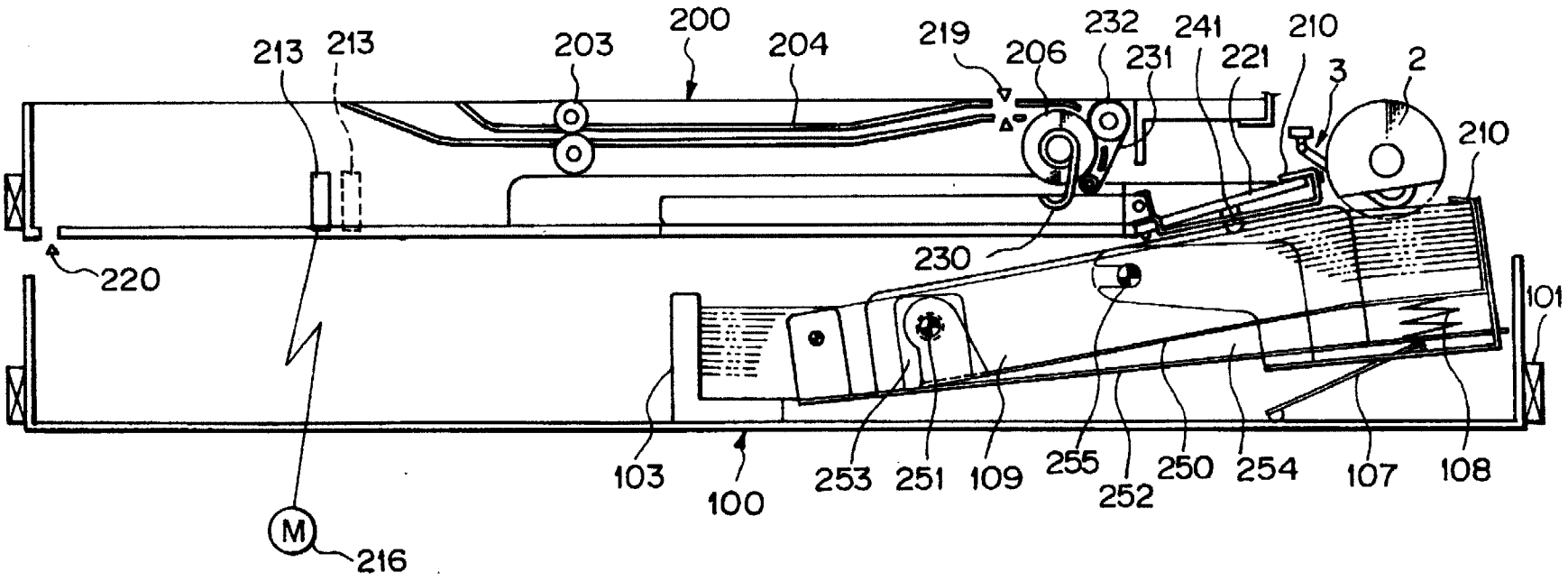
FIGS. 45 and 46 area vertical sections respectively showing a second and a third modification of the third embodiment.
Figure 46:
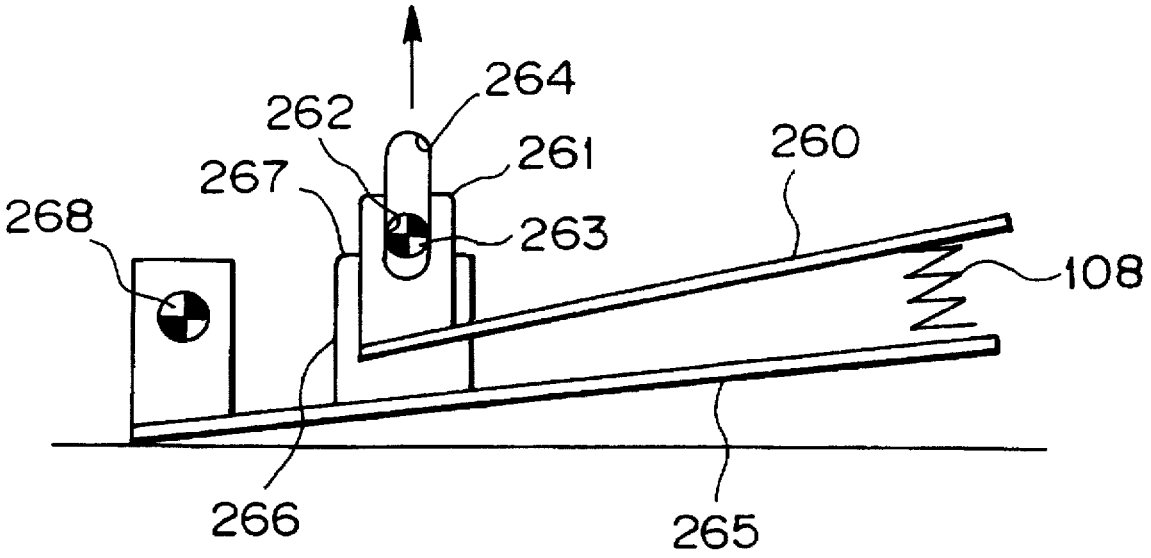

FIGS. 45 and 46 respectively show a second and a third modification of the third embodiment. Briefly, the second modification differs from the first modification in respect of the fulcrum of rotation of the first bottom plate 105. In the embodiment and its modification, the first bottom plate 105 has a fulcrum of rotation on the sheet feed tray 100. This brings about a drawback that when the second bottom plate 106 is elevated, the fight end of the bottom plate 105 sequentially moves away from the separators 110. It is therefore likely that the separators 110 fail to sufficiently retain the sheet stack 109, resulting in defective sheet separation and other troubles.

In light of the above, as shown in FIG. 45, the support 253 extends upright from the side edge of the second movable bottom plate 252. The first movable bottom plate 250 has a fulcrum of rotation 251 on the support 253. The side fence 254 is positioned at the side portion of the second bottom plate 252. Each separator 110 also has a fulcrum of rotation 255 on the side fence 254. There are also shown in FIG. 45 the home position sensor 219 responsive to the home position of the end fence 213, and the sheet sensor 220. In the modification, even when the second bottom plate 252 is raised, the range which the side fence 254 covers the sheet stack and the positional relation between the side fence 254 and the separator 110 do not change at all. This successfully obviates skewing and thereby improves the sheet feeding ability of the device.

In the third modification shown in FIG. 46, the first movable bottom plate 260 is supported by the support 261 formed with the circular hole 262. The shaft 263 is passed through the hole 262 and the vertically elongate slot 264 formed in the sheet feed tray 100. The support 266 extends upward from the side of the second movable bottom plate 265 and abuts against the shaft 263 at its top 267. The second bottom plate 265 includes the shaft 268 supported by the tray 100.

In the above configuration, when the bottom plate 265 is raised, it raises the end of the bottom plate 260 via the spring 108. The top 267 of the support 266 raises the shaft 263 along the slot 264 with the result that the fulcrum of rotation (263) of the bottom plate 260 is raised. At this instant, the fulcrum (273) is allowed to move only in the vertical direction due to the vertical slot 264. Therefore, even when the number of sheets is reduced, the inclination of the bottom plate 260 does not become sharp, and the relation between the plate 260 and the separator 110 does not change. This obviates the defective sheet separation and other troubles.

In summary, the third embodiment and its modifications have the following unprecedented advantages.

(1) A thin paper can have its opposite side edges forcibly guided. Hence, even when the sheet entering the intermediate tray has a curl, its opposite side edges can be surely guided into the tray. This is particularly true when the turn-over section has a small diameter.

(2) The turn guide members are rotated by the sheet being turned over. As a result, the resistance acting between the sheet and the guide rollers is reduced. This obviates sheet jams and the required conveying force.

(3) The guide rollers are slidable, following the movement of the side fences. Therefore, when the side fences are moved in accordance with the size of the sheets, the guide rollers are automatically brought into contact with the side edges of the sheets. Consequently, the guide rollers are capable of surely guiding the side edges of the sheets without regard to the sheet size. This reduces the number of structural elements.

(4) Despite that the guide rollers are caused to follow the movement of the side fences, they can slide and rotate smoothly.

(5) Even when the trailing edge of the sheet entered the intermediate tray has a curl, the pressing portions successfully press its opposite side edges and thereby enhances accurate stacking of the sheet on the intermediate tray.

(6) The presser members do not interfere with the sheet entering via the turn-over section and is compact. Because the presser members are mounted on the guide rollers, they can be surely positioned at and press the side edges of the sheet. In addition, the presser members are rotatable as the number of sheets stacked on the intermediate tray increases.

(7) When the sheets each having a curl are sequentially stacked on the intermediate tray, the stops limiting the elevation of the presser members delimit the space. Hence, when the sheet stack on the tray is shifted to the refeed position in the event of refeed, the top of the sheet stack is prevented from contacting, e.g., the turn-over guide plate disposed above the stack. This insures the smooth shift of the sheet stack to the refeed position.

(8) At the inlet and outlet of the turn-over section, the reaction of the sheet bent along the turn rollers acts in such a manner as to urge the sheet against the turn belts. Further, at the portion between the inlet and the outlet, the sheet is pressed against the turn rollers. As a result, the sheet is surely conveyed by the belts and turn rollers while being pressed against them. Even when the sheet is curled or relatively thick, the conveyance is free from losses and needs a minimum of pressure.

(9) The turn rollers 330 are formed of resin or similar material having a small coefficient of friction against sheets. Therefore, even if the curled edge of the sheet is in contact with the turn rollers, it simply slips and drops. Moreover, such turn rollers eliminate the need for presser members and thereby reduce the number of constituent parts. As a result, the turn rollers can be brought closer to the sheet stack, i.e., the space (height) above the sheet stack can be reduced in order to reduce the overall thickness and size of the duplex unit.

(10) The sheet entered the tray has its leading edge stopped by the end fence and has its trailing edge moved along the auxiliary rollers by the turn belts. This prevents the trailing edge of the sheet stack from contacting the auxiliary rollers when shifted to the refeed position.

(11) Every time the sheet is introduced into the tray via the turn-over section, it is shifted toward the refeed position. Therefore, the curled portion of the sheet is prevented from contacting the turn-over section in the event of refeed while the leading edge of the following sheet is prevented from being blocked by the curled portion of the preceding sheet. In addition, the trailing edge of the sheet can be positioned below the auxiliary rollers without regard to the height of its curl. In this manner, the sheets each having a curl can be desirably stacked on the tray.

Various modifications will become possible for those skilled in the art after receiving the teachings of the present disclosure without departing from the scope thereof.

What is claimed is:

1. A duplex sheet feeding device comprising:

a sheet feed tray for storing a stack of sheets;

pay-out means for paying out sheets one by one;

a sheet feeding device for conveying sheets one by one while separating said sheets, and including separators positioned in front of said sheet feed tray and respectively contacting opposite side edges of a leading edge of the stack; and a duplex unit disposed in a space above said sheet feed tray and rearward of said pay-out means, and comprising an intermediate tray for receiving a stack of sheets each carrying an image on one side thereof, and a bottom plate movable back and forth in an intended direction of sheet refeed while supporting a leading edge of said stack;

wherein said bottom plate includes separators, and wherein said bottom plate shifts the stack of sheets loaded on said intermediate tray to a preselected refeed position and then causes the sheets to be refed to an image forming section while sharing said pay-out means with said sheet feed tray.

2. A device as claimed in claim 1, wherein said bottom plate is caused to retract upward when the sheets are to be fed from said sheet feed tray underlying said duplex unit.

3. A device as claimed in claim 1, wherein said duplex unit further comprises movable side fences mounted on said intermediate tray for positioning opposite side edges of the sheets, wherein said separators of said bottom plate are respectively mounted on said movable side fences in such a manner as to be movable back and forth in the intended direction of sheet refeed.

4. A device as claimed in claim 1, wherein said duplex unit further comprises a movable end fence for positioning a trailing edge of the stack loaded on said intermediate tray and pushing said stack to a position where the sheets can be refed, and wherein said bottom plate is interlocked to said movable side fences with respect to movement.

5. A device as claimed in claim 1, wherein said duplex unit further comprises guide members for guiding, when the stack is shifted to said position where the sheets can be refed, opposite side edges of said stack and guiding opposite side edges of the sheet into said separators.

6. A device as claimed in claim 1, wherein said sheet feed tray comprises a first bottom plate for supporting the sheets, a second bottom plate positioned below said first guide plate, and spring means interposed between said first bottom plate and said second bottom plate for exerting a pressing force, and wherein said second bottom plate is selectively raised or lowered for moving said sheets toward a position where the sheets can be fed or retracting said sheets away from said position.

7. A device as claimed in claim 1, wherein said bottom plate includes a projection protruding from a bottom thereof, and wherein a pressing force to act on said bottom plate at a time of refeed is exerted by a pressing mechanism assigned to said sheet feed tray.

8. A device as claimed in claim 1, wherein said separators of said bottom plate are rotatable only upward.

9. A duplex sheet feeding device comprising:

a sheet feed tray including a first movable bottom plate, and for storing a stack of sheets;

pay-out means for feeding sheets with a roller being pressed against the sheets;

a sheet feeding device for conveying sheets one by one while separating said sheets, and including separators positioned in front of said sheet feed tray and respectively contacting opposite side edges of a leading edge of the stack; and a duplex unit disposed in a space above said sheet feed tray and rearward of said pay-out means, and comprising an intermediate tray for receiving a stack of sheets each carrying an image on one side thereof, and a second movable bottom plate movable back and forth in an intended direction of sheet refeed while supporting a leading edge of said stack;

wherein after the stack loaded on said intermediate tray and supported by said second movable bottom plate has been bodily shifted to a preselected refeed position, said first movable bottom plate of said sheet feed tray is raised to thereby raise said second movable bottom plate, wherein the sheets shifted to said preselected refeed position are refed toward an image forming section by said pay-out means shared by said sheet feed tray and said duplex unit, wherein said second movable bottom plate includes a presser portion for pressing the sheets stacked on said sheet feed tray in contact with said sheets, and wherein said presser portion is positioned close to a fulcrum of rotation of said second movable bottom plate with respect to a line on which said pay-out means presses said sheets.

10. A device as claimed in claim 9, wherein said presser portion and a contact point of said roller are arranged in a direction perpendicular to said line and in a widthwise direction of the sheets.

11. A device as claimed in claim 9, wherein said presser portion is positioned beneath said roller.

12. A device as claimed in claim 9, wherein said presser portion comprises at least two presser portions.

13. A device as claimed in claim 9, wherein said presser portion comprises a driven roller.

14. A duplex sheet feeding device for an image forming apparatus, comprising:

a sheet feed tray including a first movable bottom plate, and for storing a stack of sheets;

pay-out means for feeding sheets with a roller being pressed against the sheets;

a sheet feeding device positioned in front of said sheet feed tray for conveying sheets one by one while separating said sheets; and a duplex unit disposed in a space above said sheet feed tray and rearward of said pay-out means, and comprising an intermediate tray for receiving a stack of sheets each carrying an image on one side thereof;

wherein sheets sequentially conveyed from an image forming section of said image forming apparatus are each turned over by a turn-over section and then stacked on said intermediate tray, wherein said pay-out means sequentially refeeds said sheets one by one toward said image forming section, wherein said intermediate tray includes side fences having respective turn-over guide members for guiding opposite side edges of said sheets, and wherein said turn-over guide members guide inner surfaces of said sheets.

15. A device as claimed in claim 14, wherein said turn-over guide members comprise rotary bodies.

16. A device as claimed in claim 15, wherein said turn-over guide members are slidable, following a movement of said side fences.

17. A device as claimed in claim 15, wherein said turn-over guide members are each formed with an annular groove in a periphery thereof, and wherein said side fences are each engaged with the respective annular groove.

18. A device as claimed in claim 14, wherein said turn-over guide members each includes a respective sheet pressing member.

19. A device as claimed in claim 18, wherein said turn-over guide members are each formed with an annular groove in a periphery thereof, and wherein said sheet pressing member is rotatably provided in said annular groove.

20. A device as claimed in claim 18, wherein said side fences each includes a respective stop for limiting an upward movement of said sheet pressing member.

21. A duplex sheet feeding device for an image forming apparatus, comprising:

a sheet feed tray including a first movable bottom plate, and for storing a stack of sheets;

pay-out means for feeding sheets with a roller being pressed against the sheets;

a sheet feeding device positioned in front of said sheet feed tray for conveying sheets one by one while separating said sheets; and a duplex unit disposed in a space above said sheet feed tray and rearward of said pay-out means, and comprising an intermediate tray for receiving a stack of sheets each carrying an image on one side thereof;

wherein sheets sequentially conveyed from an image forming section of said image forming apparatus are each turned over by a turn-over section and then stacked on said intermediate tray, wherein said pay-out means sequentially refeeds said sheets one by one toward said image forming section, and wherein said turn-over section comprises a drive side consisting of a drive roller, a turn belt, and an auxiliary roller, and a driven side in a form of a turn roller rotatably mounted on a turn shaft.

22. A device as claimed in claim 21, wherein said turn roller is formed of resin or similar material having a small coefficient of friction against the sheets.

23. A device as claimed in claim 21, wherein said intermediate tray includes a movable end fence, and wherein a distance between said movable end fence and said auxiliary roller is selected to be smaller than a length of the sheet.

24. A device as claimed in claim 23, wherein lugs are formed on an outer periphery of said turn belt for catching an end of each sheet.

25. A device as claimed in claim 21, further comprising a controller for causing, every time the sheet is driven into said intermediate tray after being turned over, said sheet to be pushed in an intended direction of sheet refeed by a preselected distance.

* * * * *